US006361366B1

(12) United States Patent
Shuey et al.

(10) Patent No.: US 6,361,366 B1
(45) Date of Patent: Mar. 26, 2002

(54) HIGH SPEED MODULAR ELECTRICAL CONNECTOR AND RECEPTACLE FOR USE THEREIN

(75) Inventors: Joseph B. Shuey, Camp Hill; Stuart C. Stoner, Lewisberry, both of PA (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 09/485,870

(22) PCT Filed: Aug. 17, 1998

(86) PCT No.: PCT/US98/17096

§ 371 Date: Jun. 6, 2000

§ 102(e) Date: Jun. 6, 2000

(87) PCT Pub. No.: WO99/09616

PCT Pub. Date: Feb. 25, 1999

Related U.S. Application Data

(60) Provisional application No. 60/056,596, filed on Aug. 20, 1997, and provisional application No. 60/076,277, filed on Feb. 27, 1998.

(51) Int. Cl.[7] ..... H01R 13/648

(52) U.S. Cl. ..... 439/608

(58) Field of Search ..... 439/607–610

(56) References Cited

U.S. PATENT DOCUMENTS

| | | | | |
|---|---|---|---|---|
| 4,973,260 A | | 11/1990 | Madore et al. | |
| 5,066,236 A | | 11/1991 | Brooksteeg | |
| 5,429,521 A | | 7/1995 | Morlion et al. | |
| 5,433,618 A | | 7/1995 | Morlion et al. | |
| 5,518,422 A | | 5/1996 | Zell et al. | |
| 5,672,064 A | | 9/1997 | Provencher et al. | |
| 5,718,606 A | | 2/1998 | Rigby et al. | |
| 6,171,149 B1 | * | 1/2001 | Van Zanten | 439/608 |
| 6,174,202 B1 | * | 1/2001 | Mitra | 439/608 |
| 6,196,853 B1 | * | 3/2001 | Harting et al. | 439/79 |

FOREIGN PATENT DOCUMENTS

| | | |
|---|---|---|
| DE | 40 40 551 | 12/1990 |
| EP | 0 746 060 | 8/1993 |

OTHER PUBLICATIONS

Search Report dated Sep. 29, 2000 for Application No. 98 94 2098.

* cited by examiner

*Primary Examiner*—Khiem Nguyen
(74) *Attorney, Agent, or Firm*—Woodcock Washburn LLP

(57) ABSTRACT

A receptacle for an electrical connector comprising a housing having a first face and a second face, a plurality of electrical terminals each extending from the first face to the second face, and a plurality of longitudinal sides interposed between the first face and the second face. Conductive shielding is superimposed over at least some of the longitudinal sides, and includes latches extending into the housing and proximal to at least some of the electrical terminals.

16 Claims, 30 Drawing Sheets

HIGH SPEED MODULAR ELECTRICAL CONNECTOR AND RECEPTACLE FOR USE THEREIN

This application is a 371 of PCT/US98/17096 filed Aug. 17, 1998 which claims benefit of Ser. No. 60/056,596 filed Aug. 20, 1997 and Ser. No. 60/076,277 filed Feb. 27, 1998.

BACKGROUND OF THE INVENTION

1. Field of the Invention

The present invention relates to electrical connectors and more particularly to modular connectors for use in connecting a daughter printed wiring board to a mother printed wiring board.

2. Brief Description of Prior Developments

In the manufacture of computers and other various electronic assemblies, daughter boards are commonly connected to mother boards by means of a connector having a receptacle having a plastic housing and a first and second face wherein terminals are connected in one face to the daughter board and at the other to a header connected to the mother board. Various arrangements have been suggested to ground such connectors to the mother or daughter boards but such arrangements have tended to complicate the construction of the connector. A need, therefore, exists for simple and inexpensive means for grounding connectors between mother and daughter boards. There is also a need for such a connector which reduces crosstalk and increases band width.

SUMMARY OF THE INVENTION

The receptacle of the present invention comprises a housing having a first face and a second face and a plurality of signal conducting means. Each of these terminals extends from said first face to said second face. The housing has a plurality of longitudinal sides interposed between said first face and said second face, and there being a conductive shielding means superimposed over at least some of said longitudinal sides. Interior conductive shielding means are interposed between at least some of said signal conductive means.

In the electrical connector of the present invention the above described receptacle is connected to a daughter board through a shielded header. The header has two end walls and a medial wall and is comprised of a conductive material, preferable a suitable metallic alloy. A plurality of apertures extend through the medial wall and retain signal pins which contact the terminals in the receptacle. There is a first and second face on the medial wall. The first face interfaces with the second face of the receptacle. The second face abuts the printed wiring board. On the second face there are a plurality of recesses into which conductive pins are press fitted to ground the connector.

BRIEF DESCRIPTION OF THE DRAWINGS

The invention is further described with reference to the accompanying drawings in which.

DETAILED DESCRIPTION OF THE PREFERRED EMBODIMENTS

Figure 1:
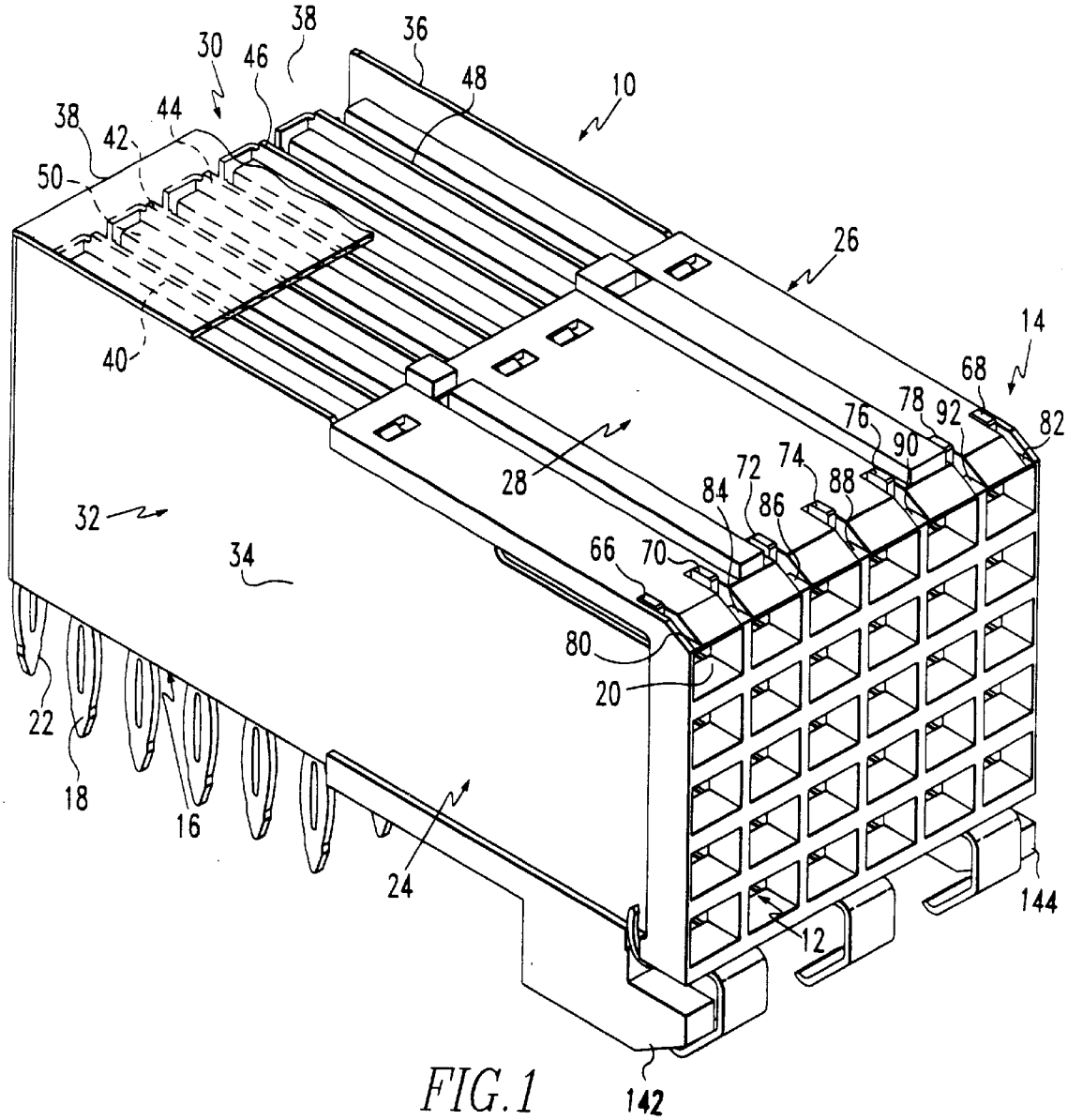
FIG. 1 is a cut-away perspective view of the receptacle of the present invention.
Figure 2:
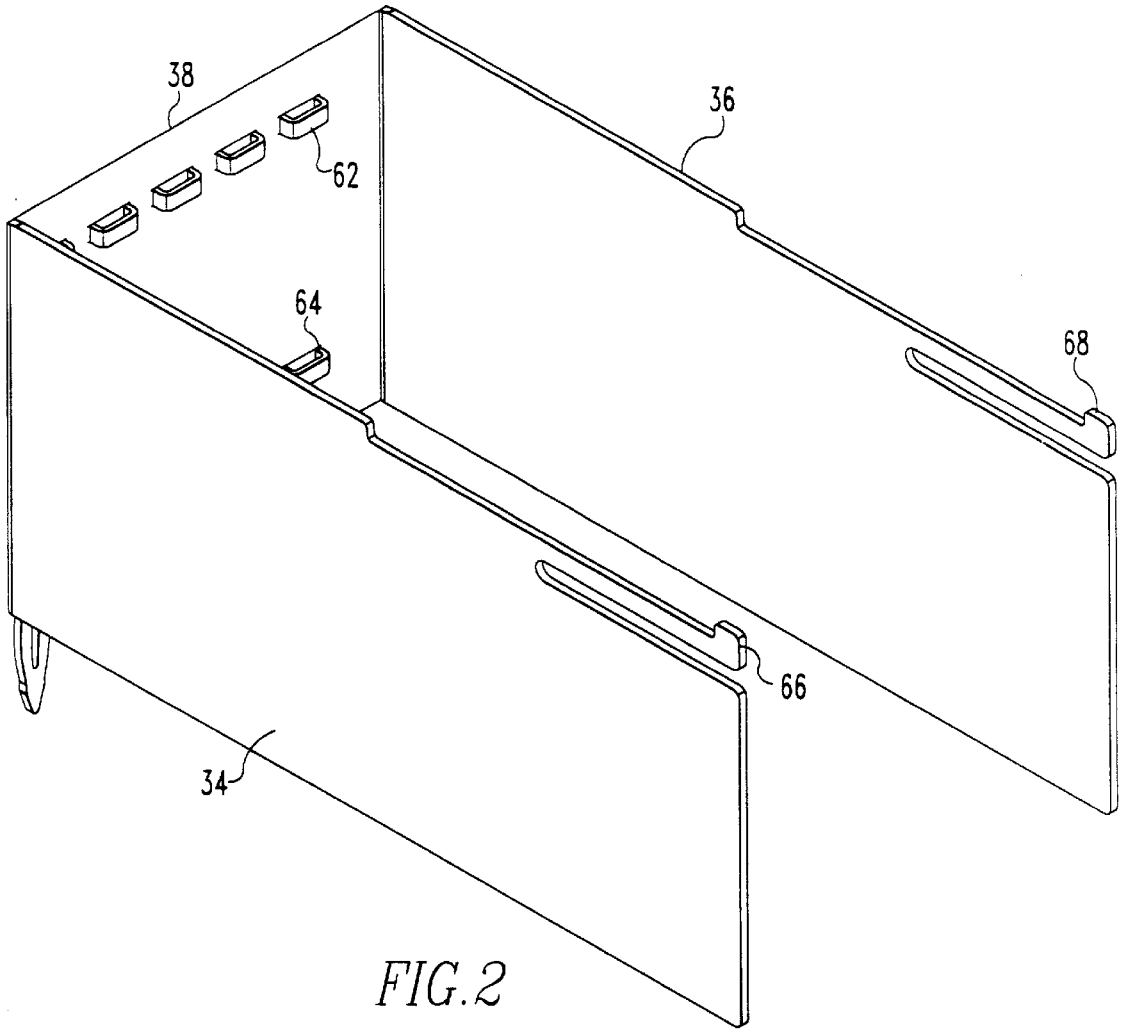
FIG. 2 is a perspective view of the exterior shielding used in the receptacle shown in FIG. 1.

Referring particularly to FIGS. 1–2, the receptacle shown generally at numeral 10. The receptacle has a first face 12 on a front insulative housing shown generally at numeral 14. The receptacle also has a second face 16 on its bottom side, and conductive signal terminals as at 18 extend from the first face to the second face. The first face has a plurality of openings as at 20 where, as is explained hereafter, pins from a header engage the signal terminals. As is conventional, the receptacle also includes ground pins as at 22. The receptacle also includes lateral longitudinal sides 24 and 26 and a top longitudinal side 28. In opposed relation to the first face there is an end 30. The longitudinal sides 24 and 26 and the end 30 are covered by a U-shaped shield 32. This shield is comprised of longitudinal sections 34 and 36 which are superimposed, respectively over longitudinal sides 24 and 26. In section 38 of the U-shaped shield 32 is superimposed over the end 30 of the receptacle 10. On longitudinal side 28 rearwardly of the insulative housing there is also a top shield (not shown).

Figure 3:
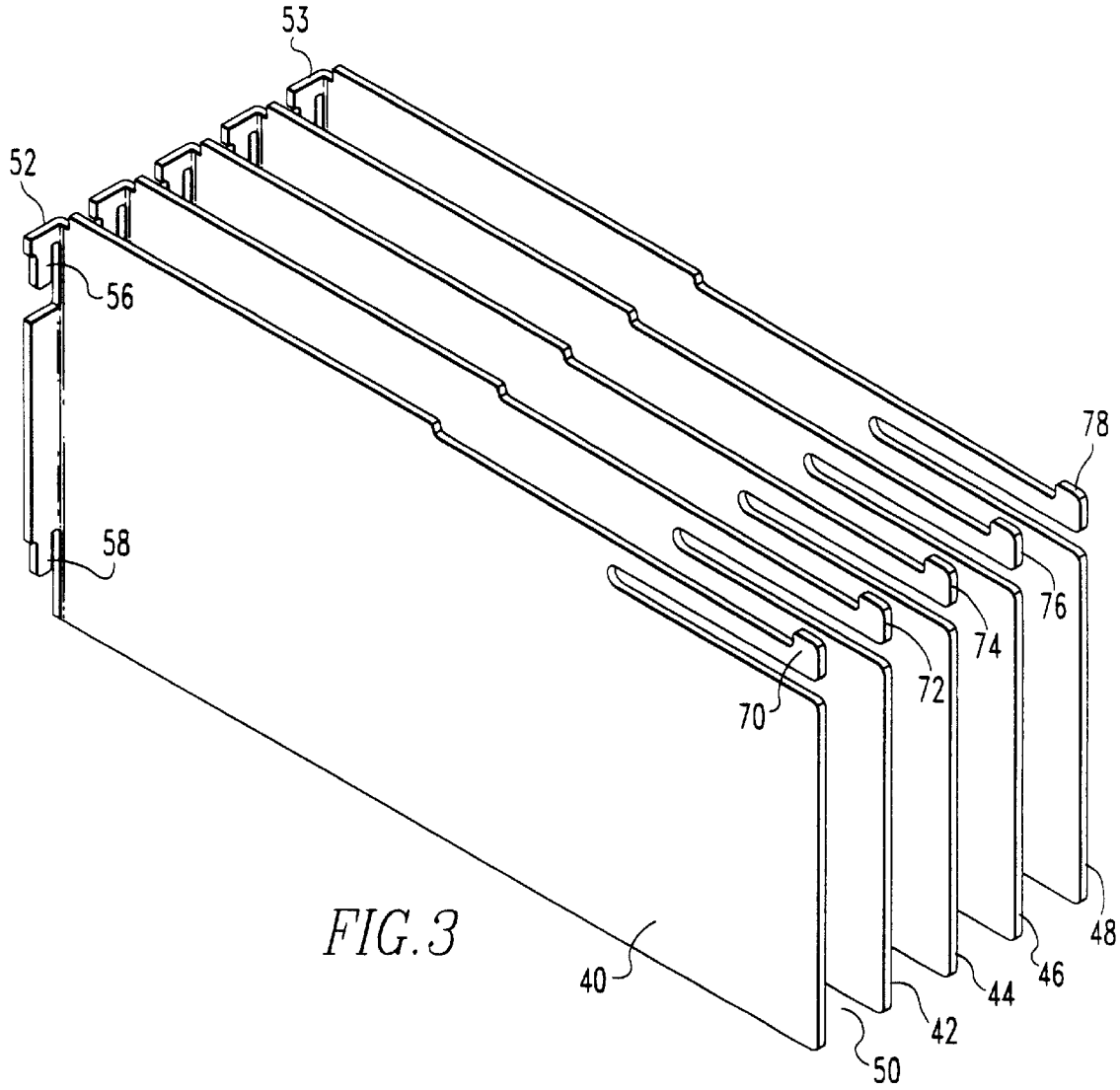
FIG. 3 is a perspective view of the interior shielding used in the receptacle shown in FIG. 1.
Figure 6:
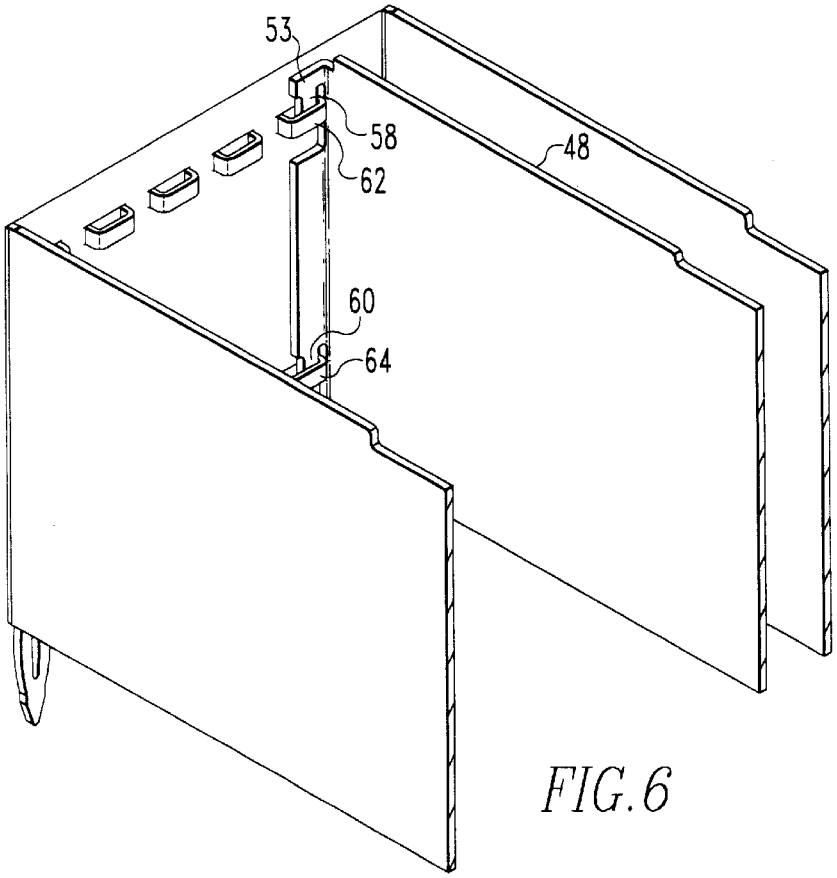
FIG. 6 is a perspective view of the exterior shielding engaged to one of the interior shields.

Referring particularly to FIGS. 1, 3 and 6, there are parallel longitudinal internal shielding walls 40, 42, 44, 46 and 48. Between these internal walls there are longitudinal spaces as at 50 (FIG. 3). Each of the internal walls also has a transverse section as at 52 and 53 (FIG. 3).

Each of these transverse sections has a pair of vertical latches as at 54 and 56 on transverse section 52 and 58 and 60 on transverse section 53. These vertical latches engage horizontal eyelets as at 62 and 64 (FIGS. 2 and 6). On the front top edge of the longitudinal section 34 of U-shaped shield 32 there is a spring latch 66. On the front top section of longitudinal section 36 of the U-shaped shield 32 there is also a spring latch 68. Similarly internal shielding wall 40 has a front spring latch 70, internal shielding wall 42 has a shielding latch 72, internal shielding wall 44 has a front spring latch 74, internal shielding wall 46 has a front shielding latch 76 and internal shielding wall 48 has a front spring latch 78.

Figure 4:
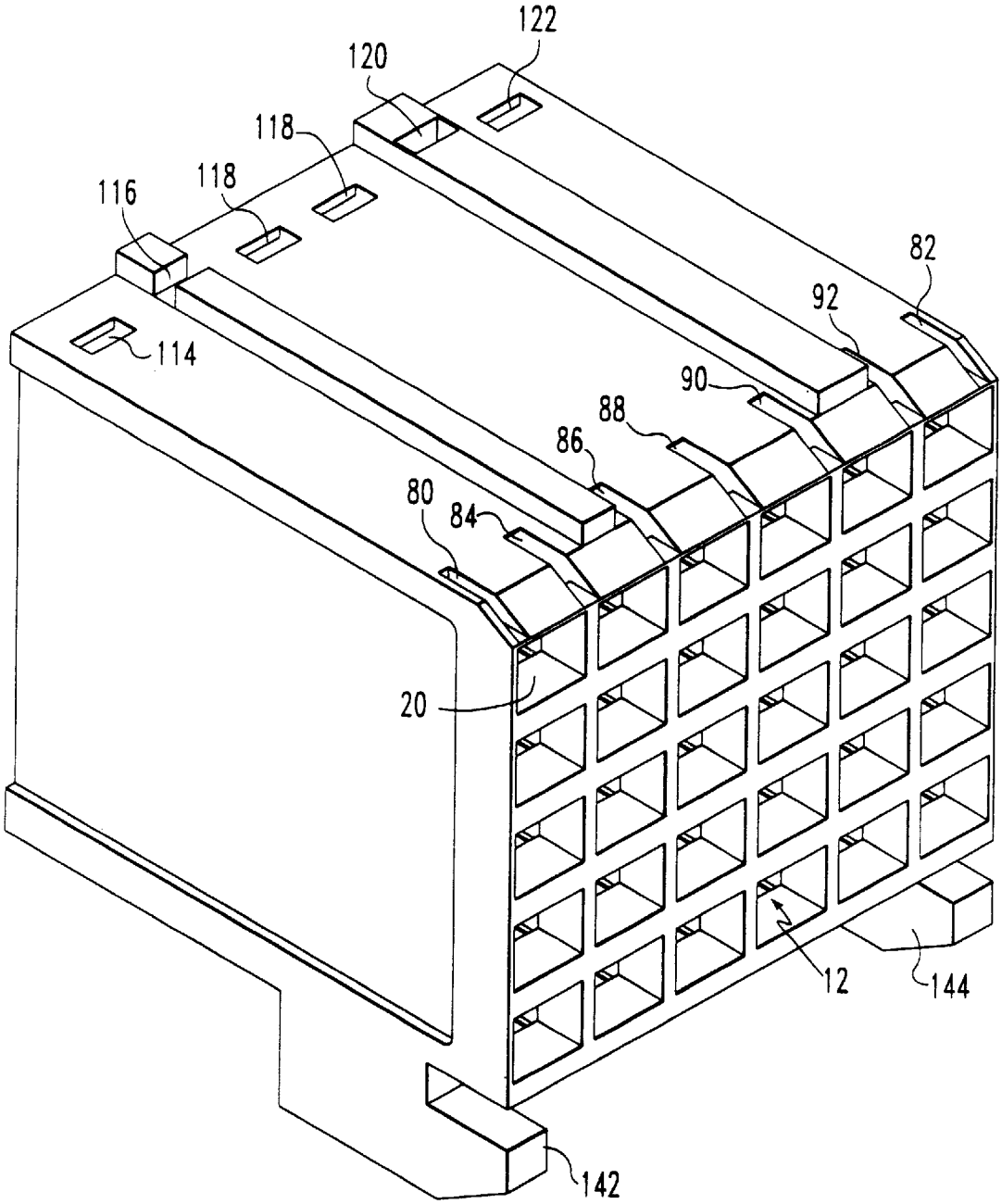
FIG. 4 is a perspective view of the insulative housing used in the receptacle shown in FIG. 1.

Referring particularly to FIG. 4, there are side slots 80 and 82 in the insulative housing. These slots are engaged, respectively, by spring latches 68 and 70. Between these slots there are medial slots 84, 86, 88, 90 and 92 which are engaged, respectively, by spring latches 70, 72, 74, 76 and 78 on the internal shielding walls.

Figure 5:
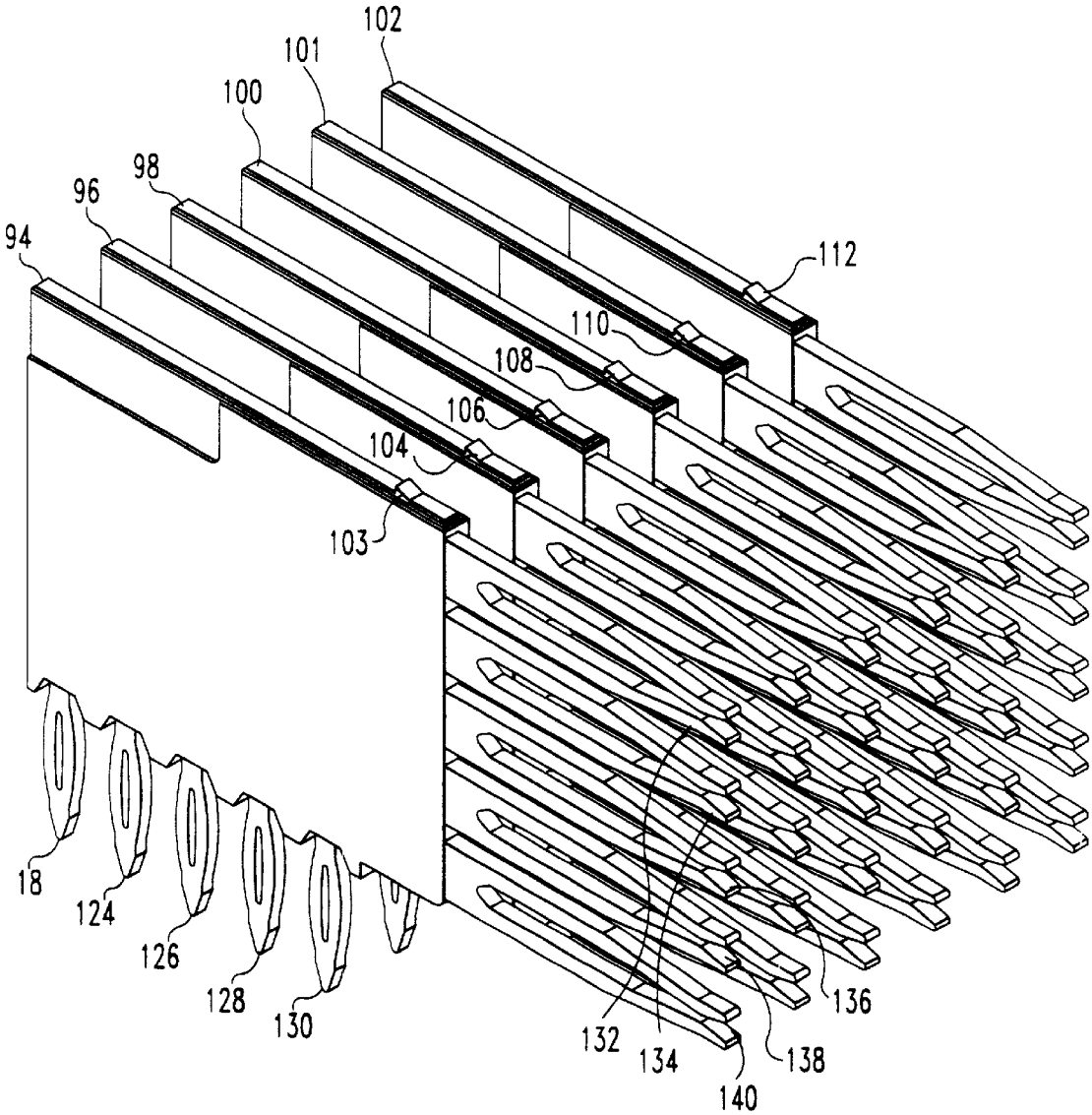
FIG. 5 is a perspective view of the composite terminals and insulative frames used in the receptacle shown in FIG. 1.

Referring particularly to FIGS. 1 and 4–5, it will be seen that the terminals are enclosed within insulative frames 94, 96, 98, 100, 101 and 102. These frames have, respectively, frame latches 103, 104, 106, 108, 110 and 112. These frame latches engage, respectively, apertures 114, 116, 118, 120 and 122 in the insulative housing (FIG. 4).

Figure 8:
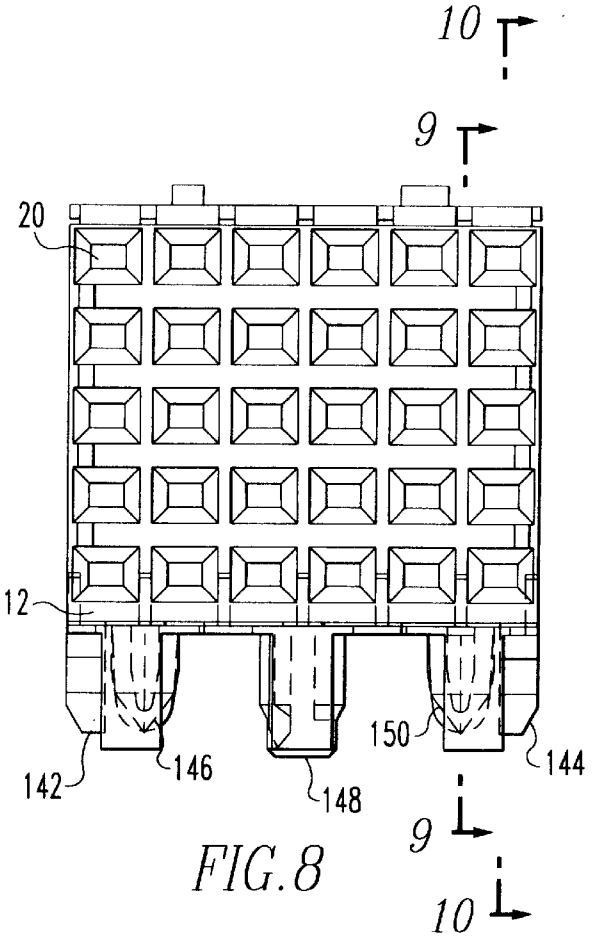
FIG. 8 is a front elevational view of the receptacle shown in FIG. 1.
Figure 7:
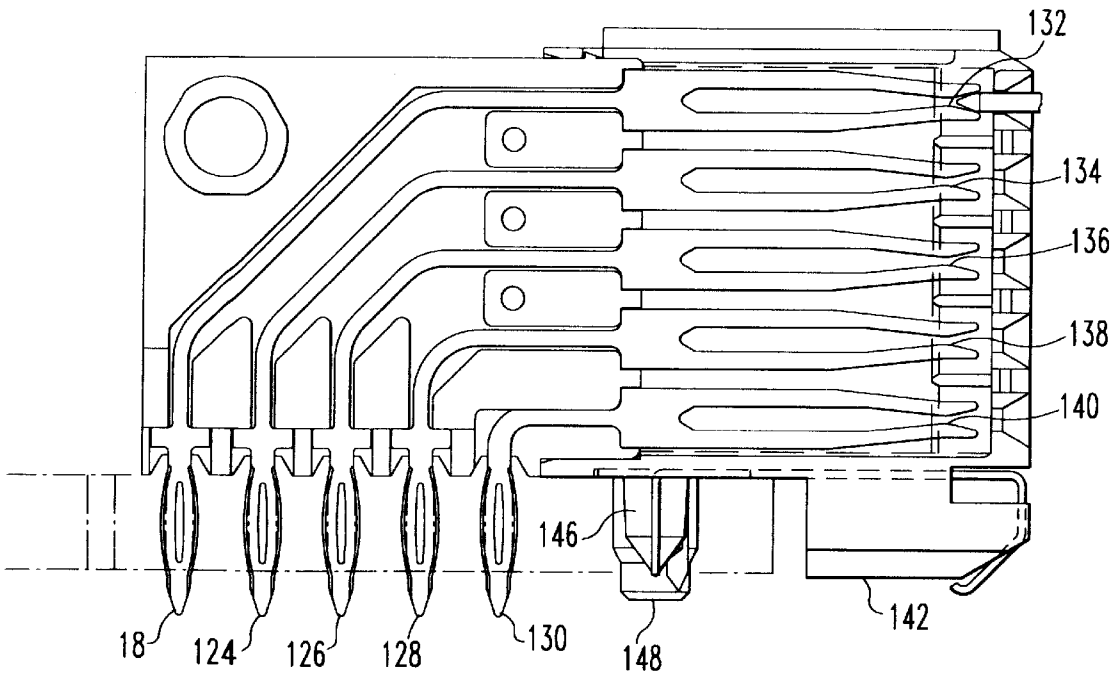
FIG. 7 is a side elevational view of the receptacle shown in FIG. 1 which is cut-away to show terminal arrangement.
Figure 9:
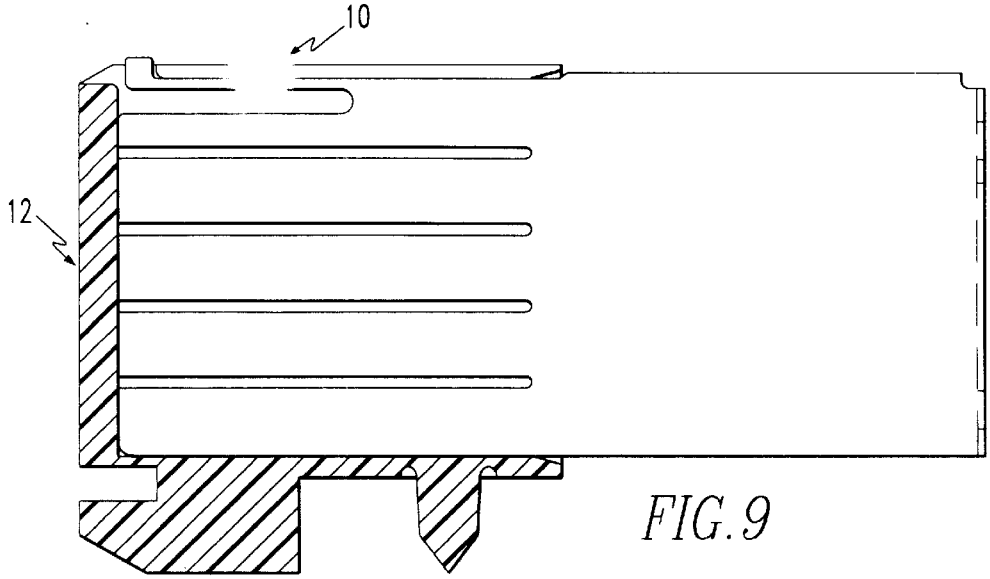
FIG. 9 is a cross sectional view through 9—9 in FIG. 8.
Figure 10:
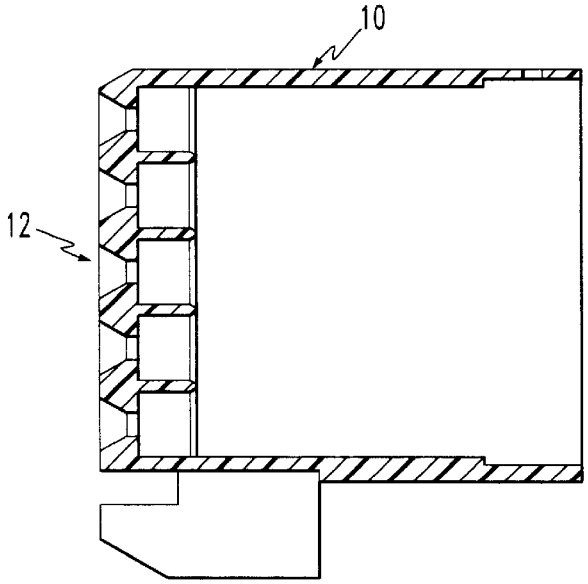
FIG. 10 is a cross sectional view through 10—10 in FIG. 8.

Referring to FIGS. 5 and 7–8 particularly, it will be seen that in addition to terminal 18, insulative frame 94 also holds signal terminal 124, 126, 128 and 130. Each of these terminals extends first upwardly and then horizontally. Each of these terminals has, respectively, at its horizontal terminal end a split pin engagement section 132, 134, 136, 138 and 140. As is conventional, the receptacle also has a pair of code key holders 142 and 144 and press pins 146, 148 and 150.

Figure 11:
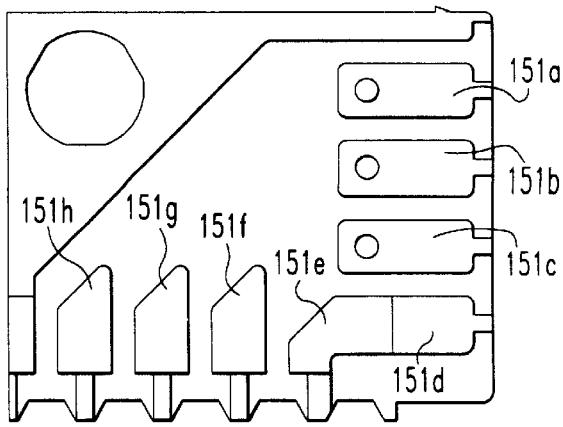
FIG. 11 is a vertical cross sectional view through an insulative frame as is shown in FIG. 4.

Referring to FIG. 11, an insulative frame is shown as being vertically bisected. This bisected frame is centrally recessed and has a plurality of contact receiving structures 151*a*–151*h*.

Figure 12:
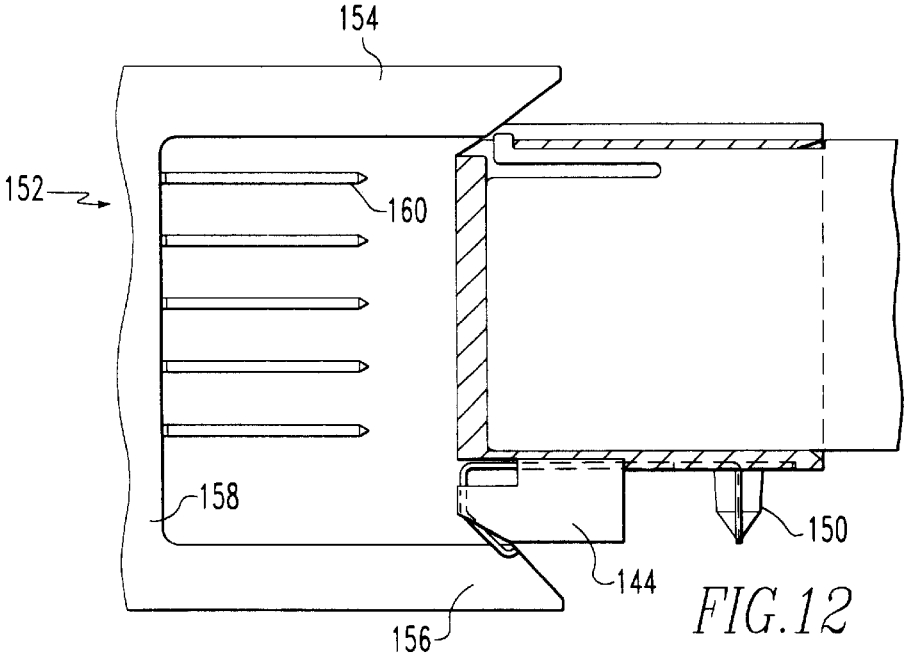
FIG. 12 is a vertical cross sectional view of the receptacle shown in FIG. 1 engaged with a header.

Referring to FIG. 12, the receptacle engages a header shown generally at numeral 152. The header has a pair of end walls 154 and 156 and a medial wall. There are apertures in the medial wall through which conductive pins as at 160 extend to engage the first face of the receptacle and be received in the split pin engagement sections of the terminals.

Figure 13:
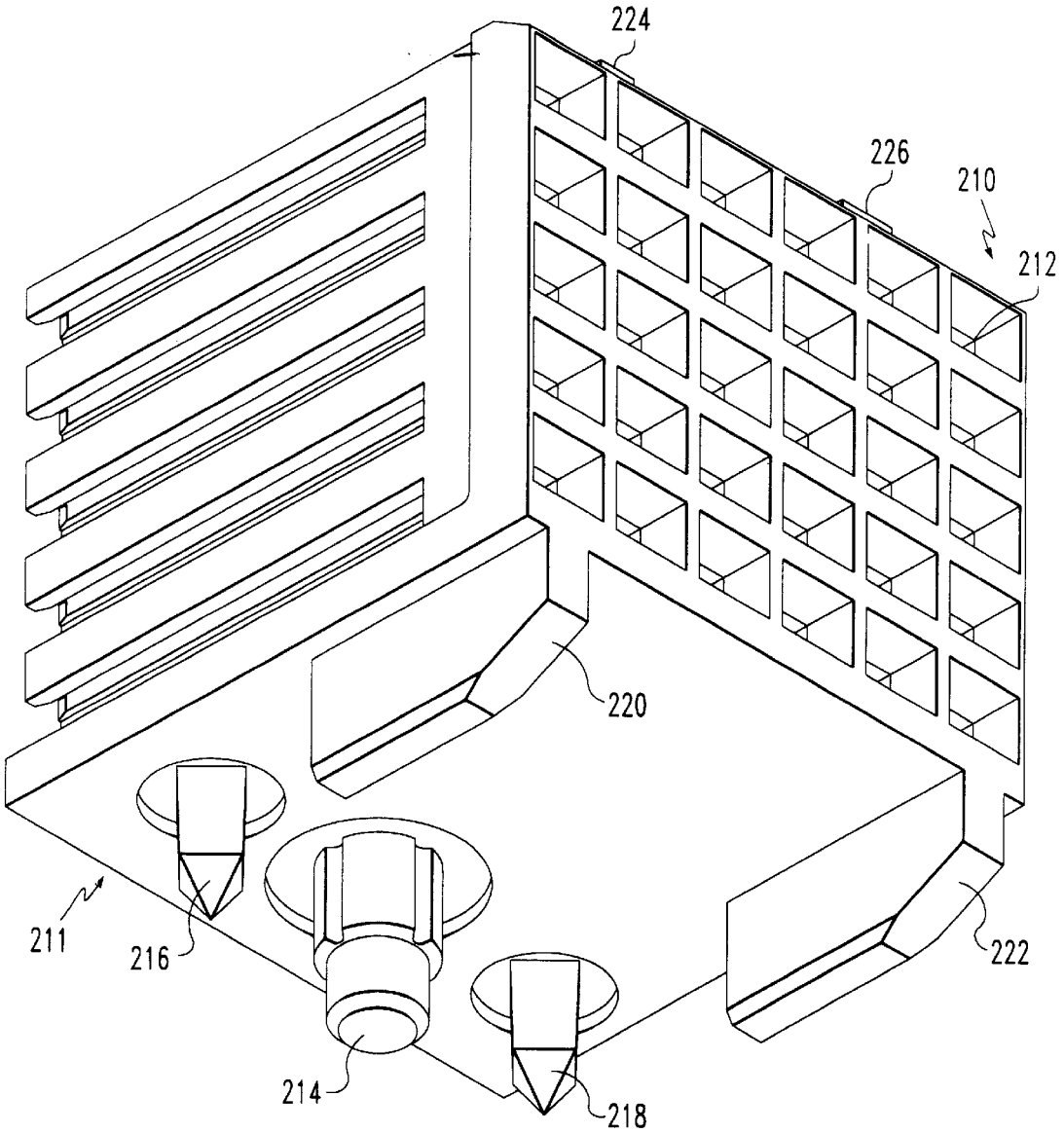
FIG. 13 is a front perspective view of a second preferred embodiment of the receptacle of the present invention.

A second embodiment is shown in FIGS. 13–20. Referring particularly to FIG. 13, the front face of the receptacle is shown generally at numeral 210 and a bottom face at 211. On this face there are conventional pin receiving apertures as at 212 for connection with the plug. The receptacle also includes, as is conventional, a press attachment peg 214 and location pegs 216 and 218. Also included are spacers 220 and 222 and polarization alignment keys 224 and 226.

Figure 14:
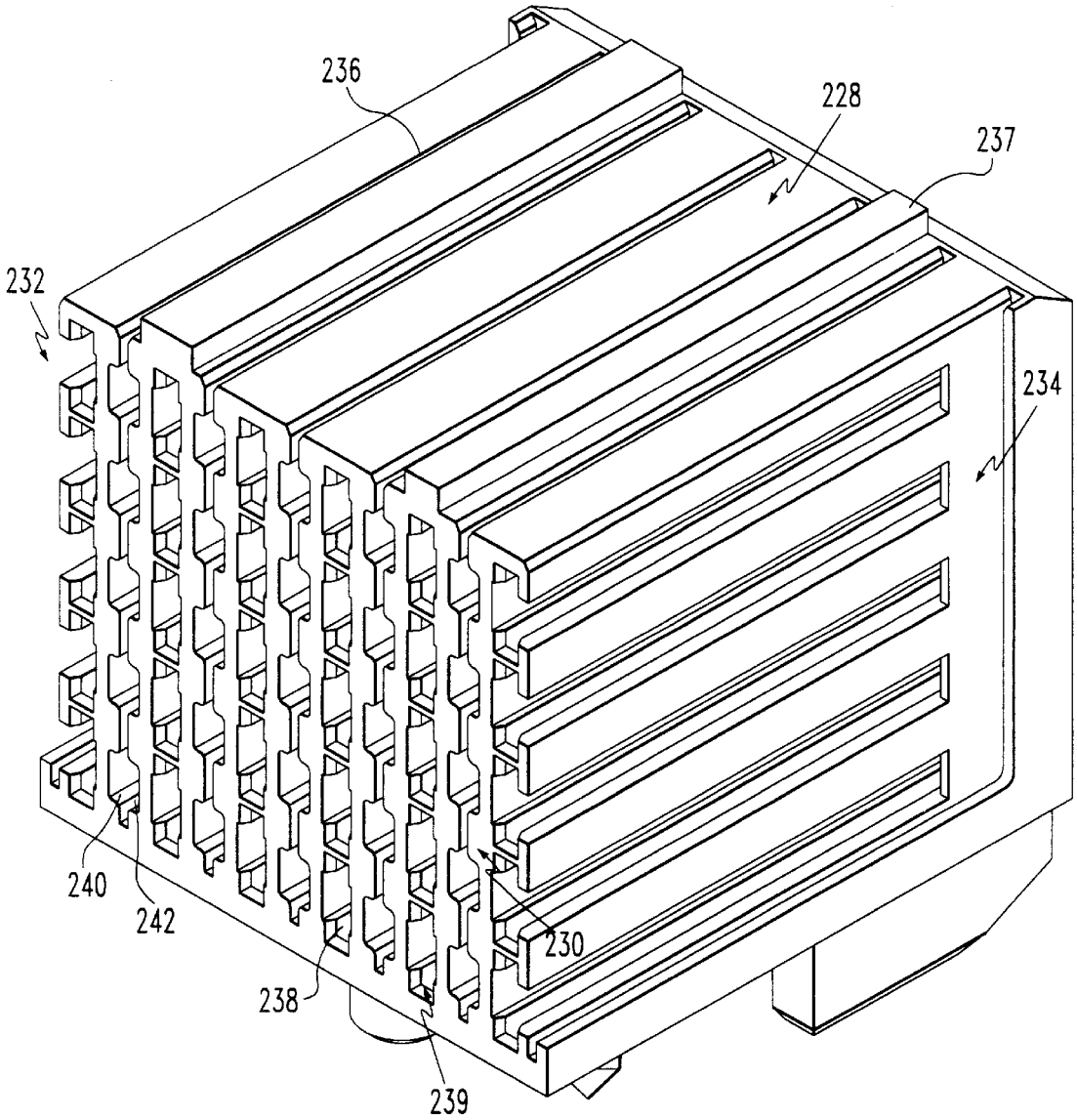
FIG. 14 is a rear perspective view of the receptacle shown in FIG. 13.
Figure 15:
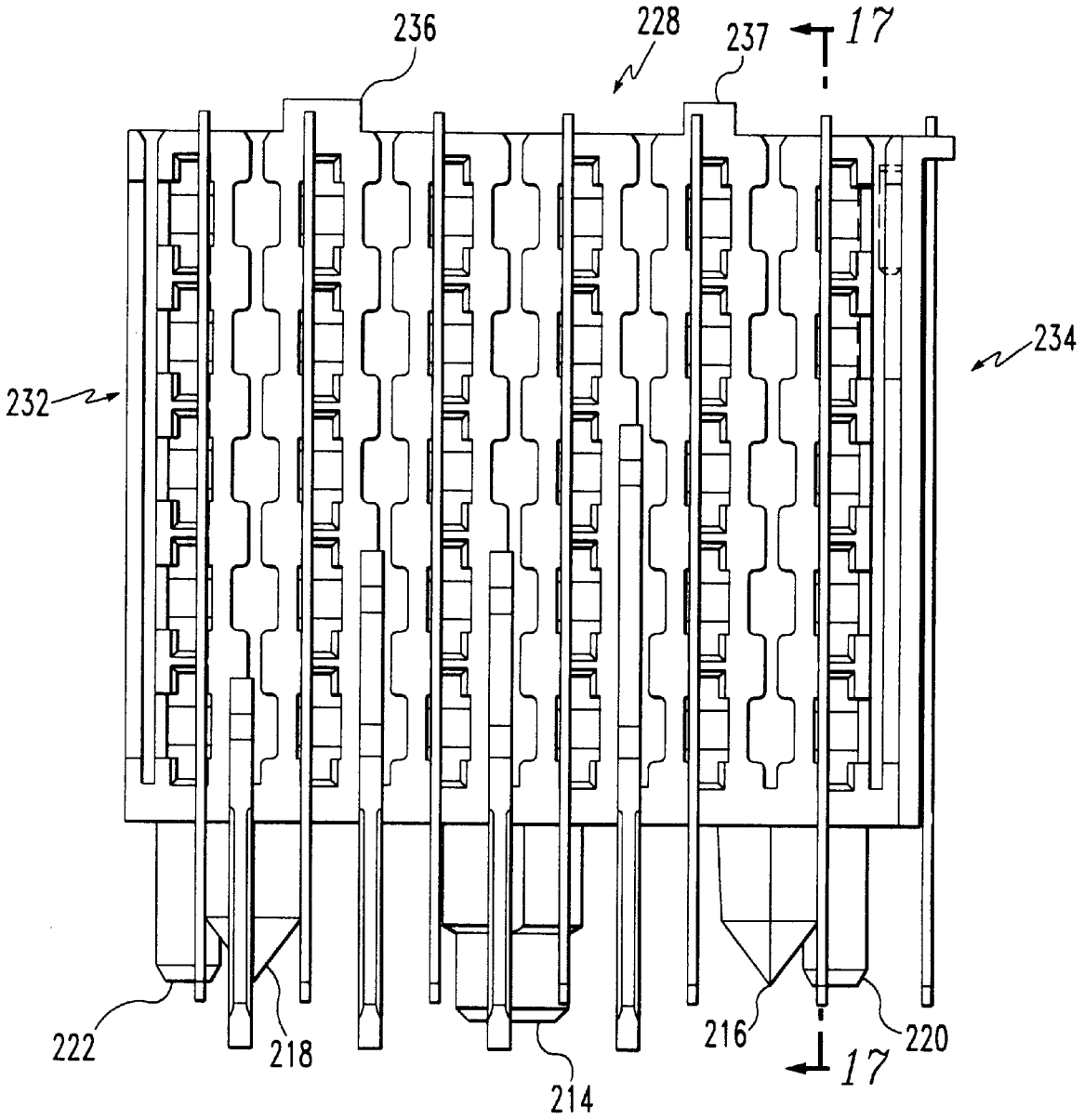
FIG. 15 is a rear elevational view of the receptacle shown in FIG. 13.

Referring particularly to FIGS. 14–15, the top face 228, rear face 230 and a side face 232 and 234 are shown in greater detail. From this figure it will be seen that there are slots as at 236 and 237 for receiving shields in the top face, bottom face and rear face which run parallel to the side faces. Between the shields there are elongated contact receiving slots as at 238 and 239. At vertical spaced intervals along the shield receiving slot there are also pairs of grooves 240 and 242.

Figure 16:
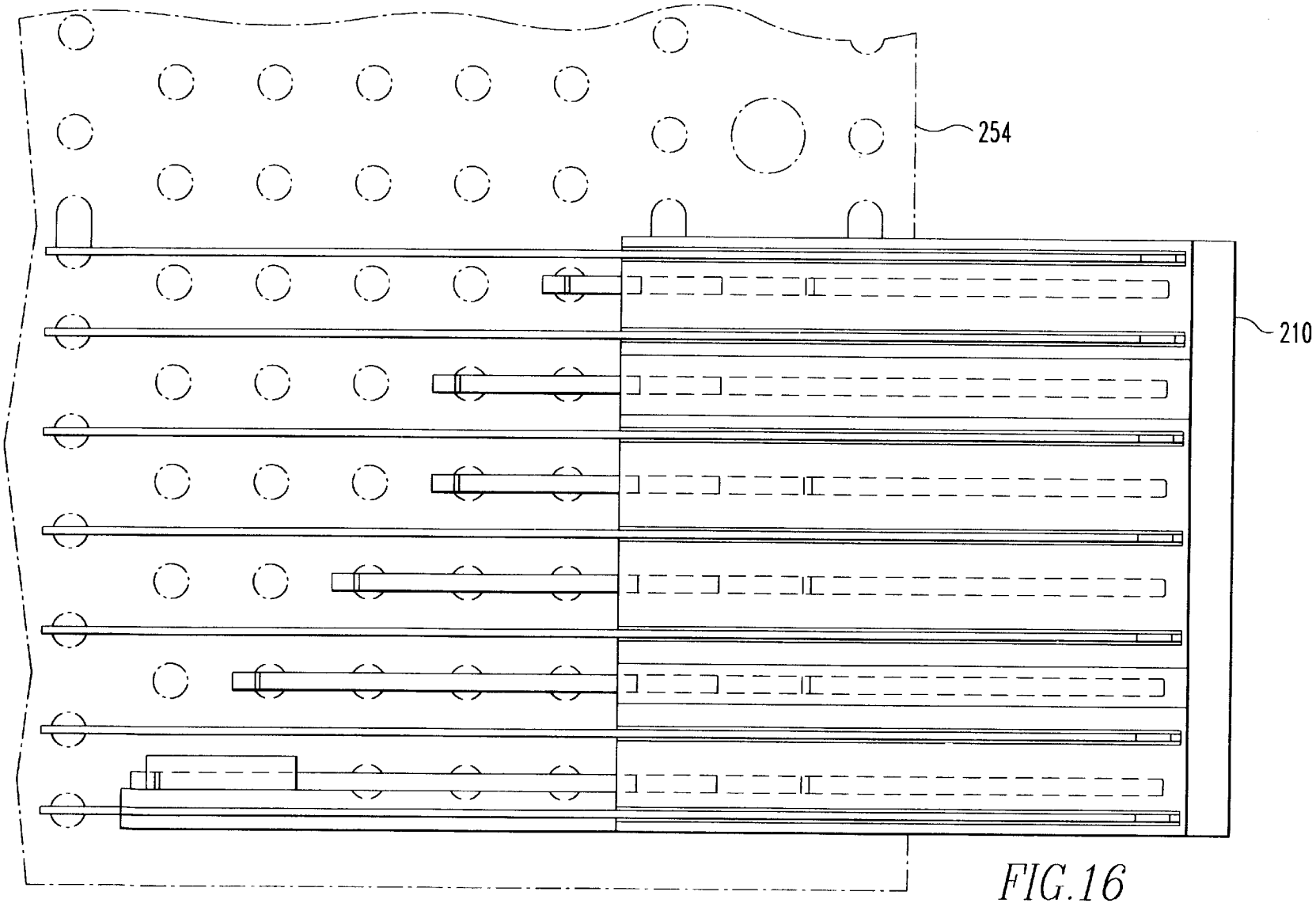
FIG. 16 is a schematic top cutaway view showing the receptacle engaging a printed circuit board.
Figure 17A:
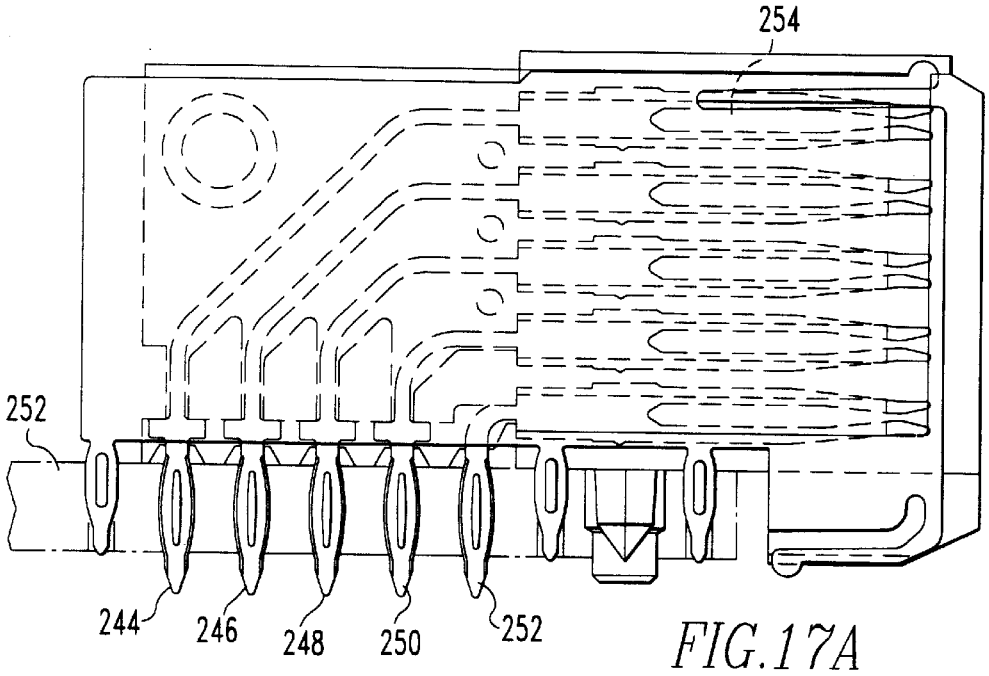
FIG. 17A is a cross sectional view through 17—17 in FIG. 15.
Figure 17B:
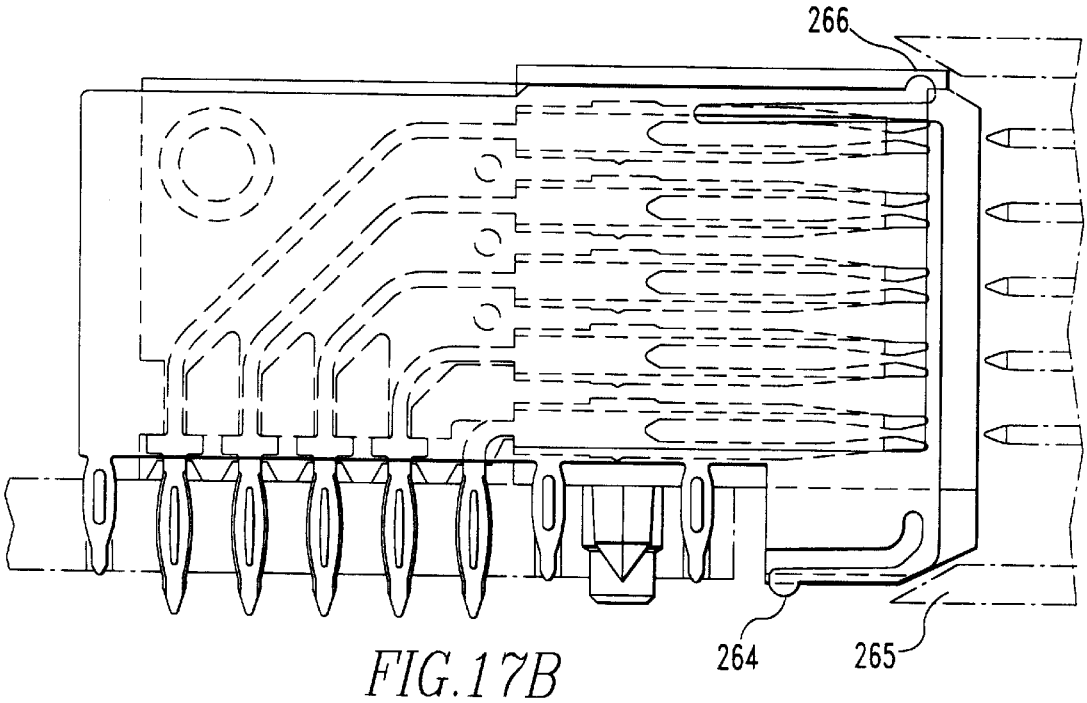
FIG. 17B is a cross sectional view similar to FIG. 17A in which the receptacle is shown engaging a header.
Figure 18:
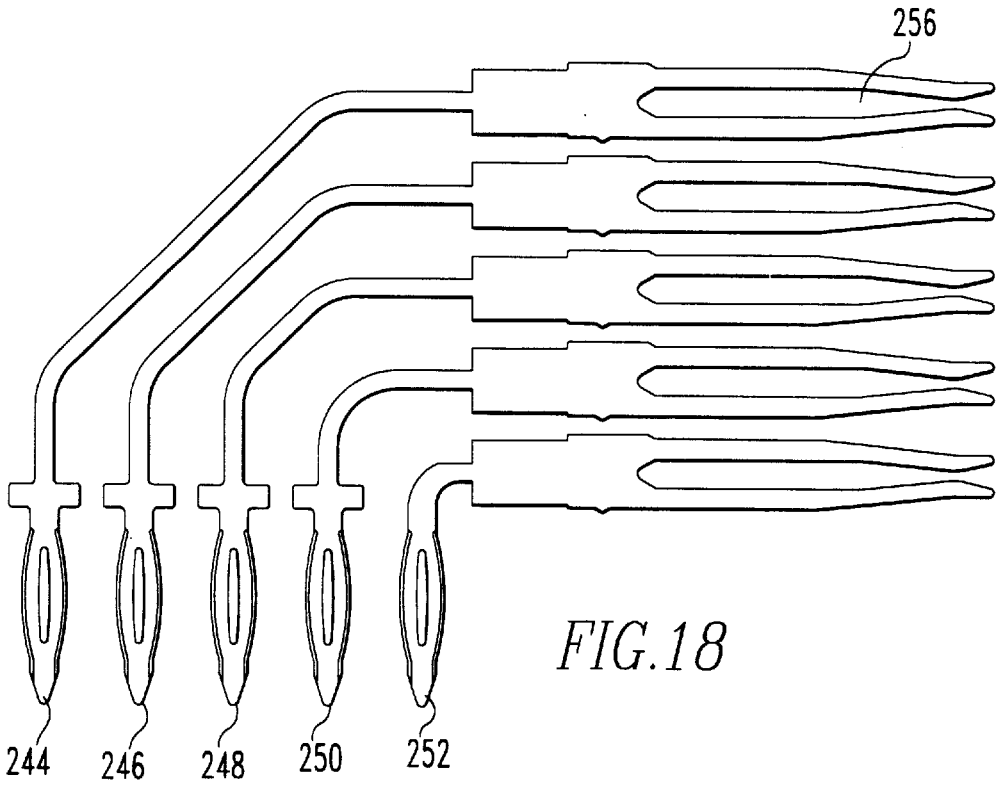
FIG. 18 is a side elevational view of a shield used in a receptacle used in FIG. 13.
Figure 19:
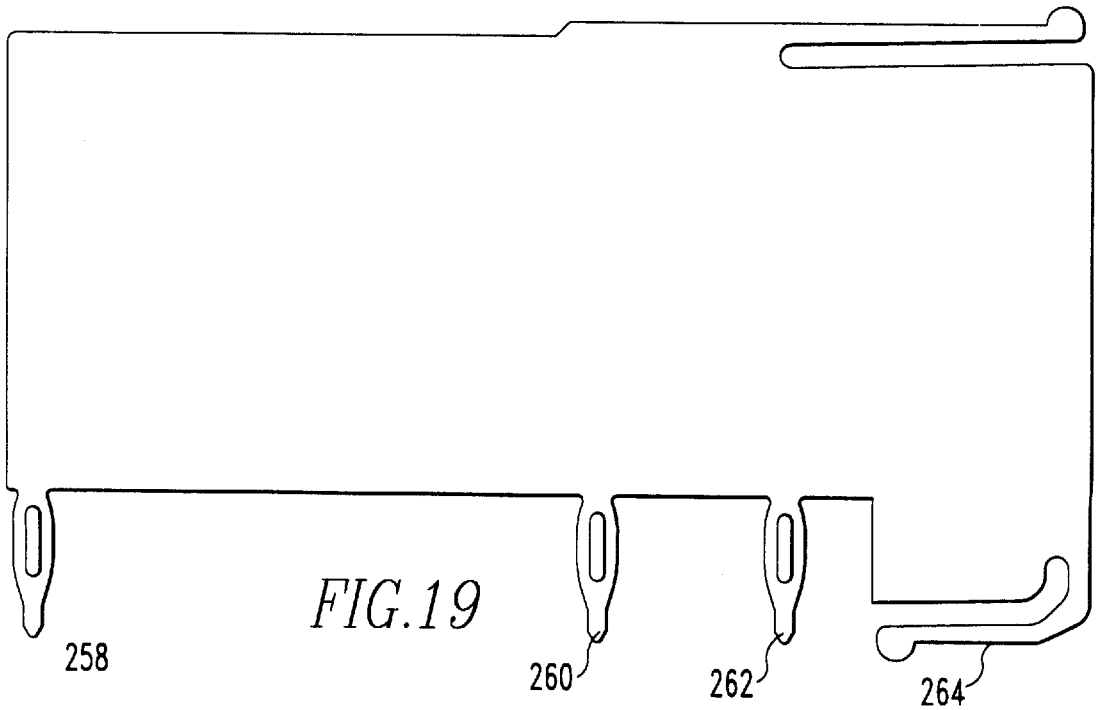
FIG. 19 is a side elevational view of contacts used in the receptacle shown in FIG. 13.
Figure 20:
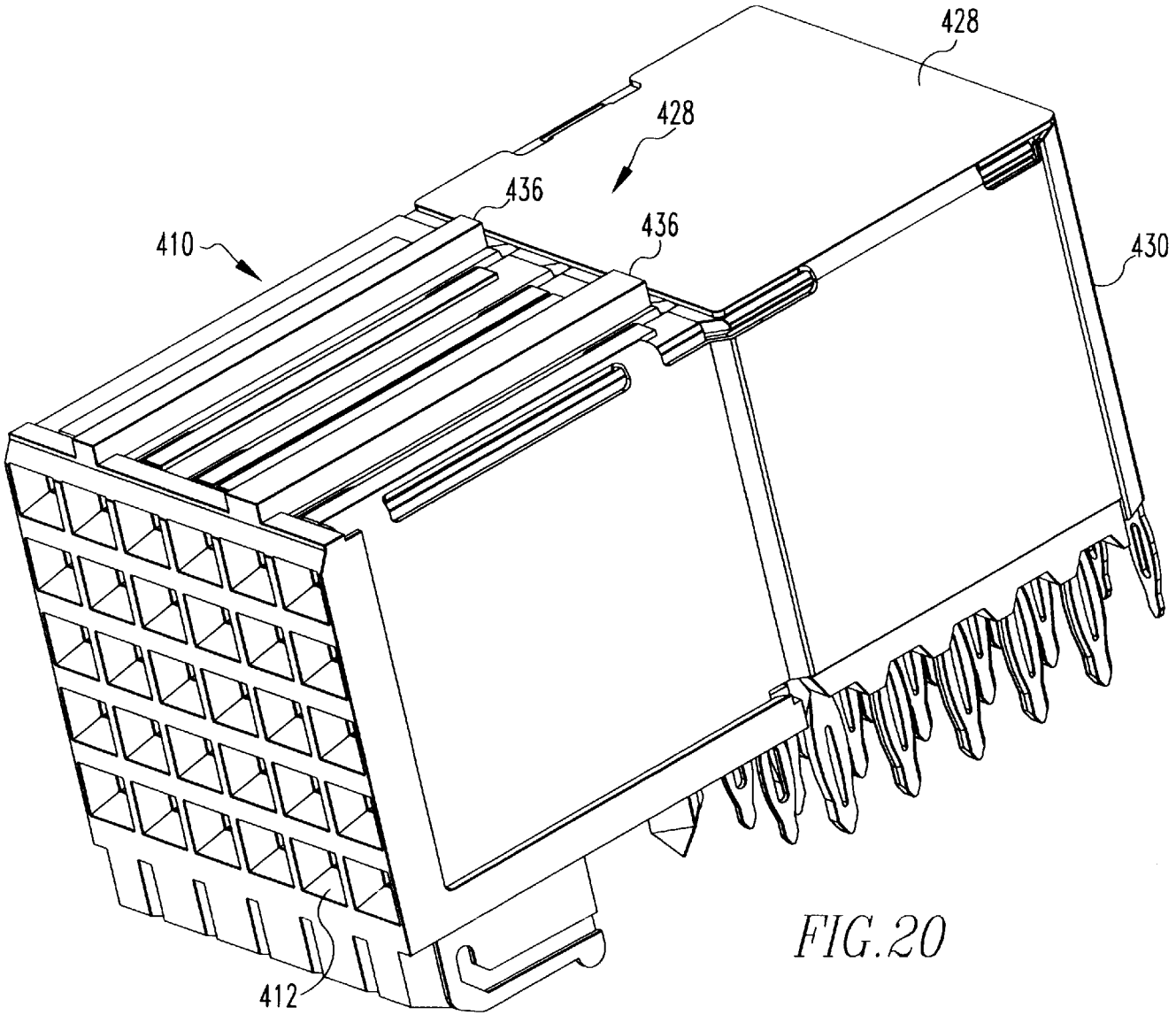
FIG. 20 is a cutaway perspective view of a third preferred embodiment of the present invention.
Figure 21:
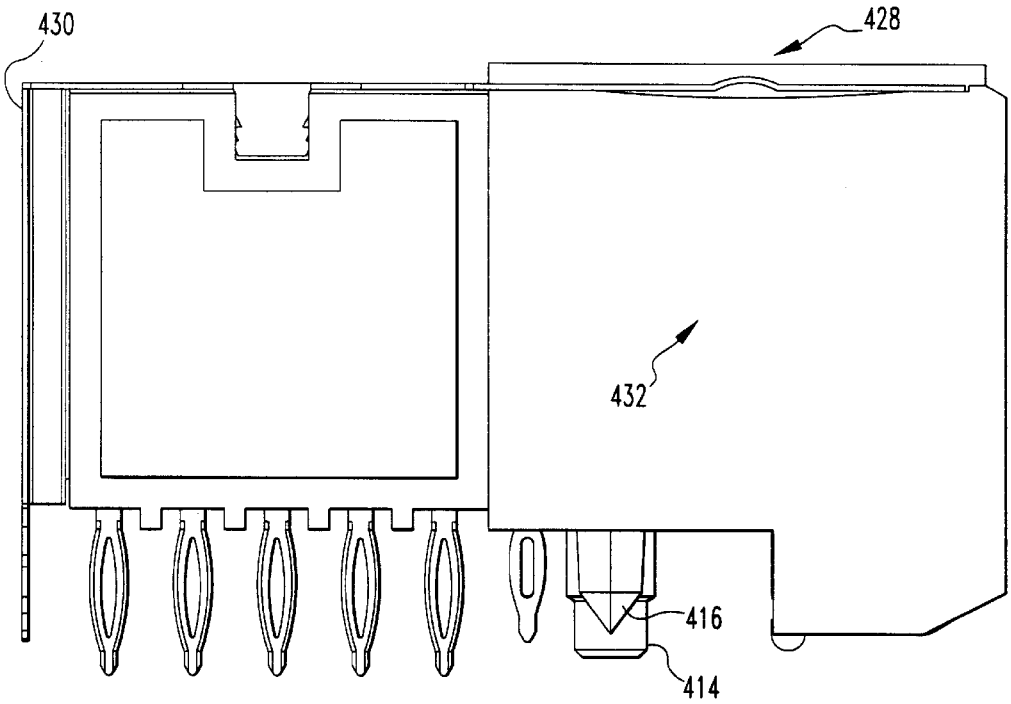
FIG. 21 is a side elevational view of the receptacle shown in FIG. 20.
Figure 23:
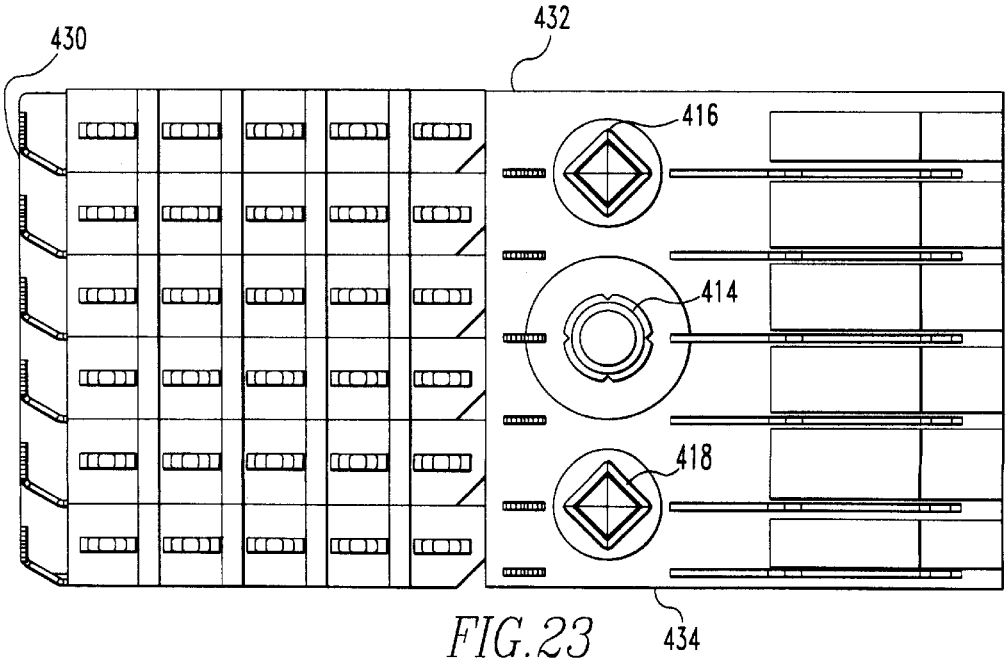
FIG. 23 is a bottom plan view of the receptacle shown in FIG. 20.
Figure 22:
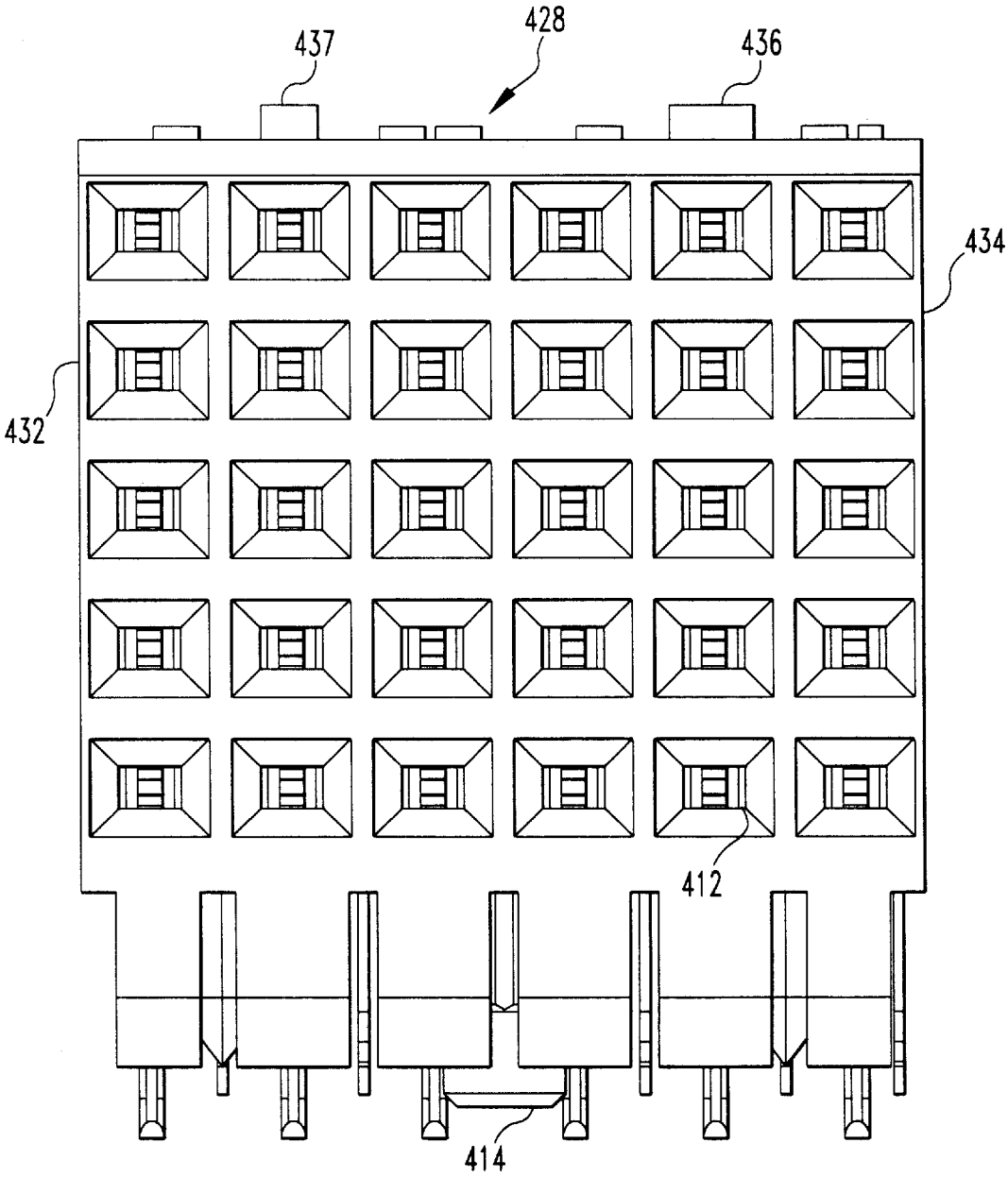
FIG. 22 is a front view of the receptacle shown in FIG. 20.
Figure 24:
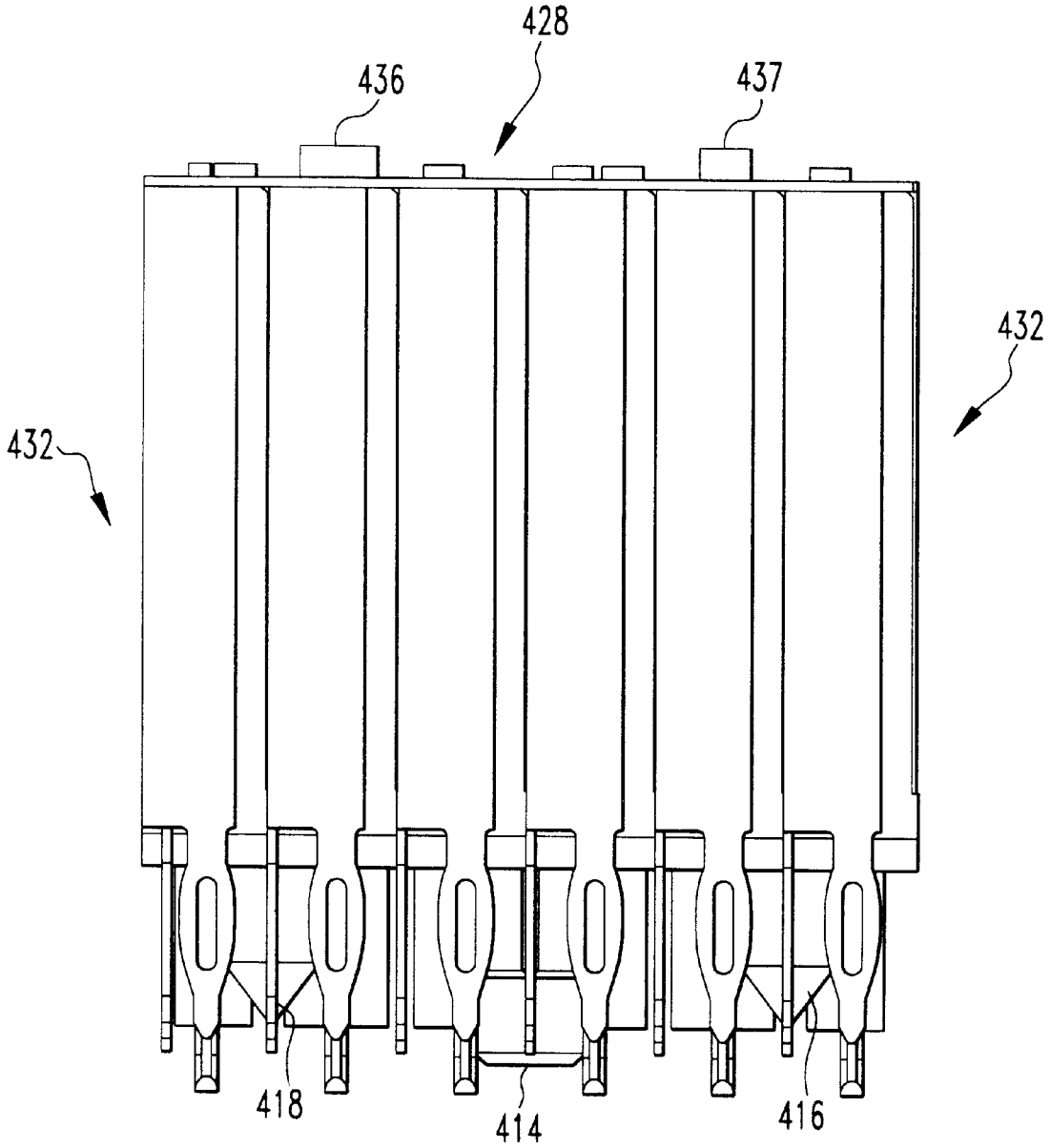
FIG. 24 is a rear end view of the receptacle shown in FIG. 20.

Referring particularly to FIGS. 16–20 signal contacts as at 244, 246, 248, 250 and 252 pass through each of the contact receiving slots in the receptacle. These contacts are connected at one end to the printed circuit board 254 (FIG. 16). (It will be understood that the contacts between individual sets of shields all extend rearwardly by the same overall length although in FIG. 16 engagement of the printed circuit board schematically shows several different rearward positions to illustrate various positions on the board which may be engaged by the contacts.) At their other end they have a V-shaped structure as at 256 to engage pins at the pin receiving apertures. Referring particularly to FIGS. 17A–17B and 19 the shields have ground pins as at 258, 260 and 262 that pass through the bottom face of the receptacle to be grounded to the PCB. The shield also has a lower resilient ground 264 which extends downwardly through a lower slot in the receptacle then rearwardly to be grounded to a shrouded header 265 (FIG. 17B). Similarily the shield has an upper resilient ground structure 266 which passes through one of the slots in the upper face of the receptacle to be grounded to a header (not shown). A header which would be suitable for engagement with these resilient ground projections would, for example, be either one shown in International Patent Application No. WO96/31922, published Oct. 10, 1996 and assigned to the assignee of this application.

A third embodiment is shown in FIGS. 20–29. The front face of the receptacle is shown generally at numeral 410 and a bottom face at 411. On this face there are conventional pin receiving apertures as at 412 for connection with the plug. The receptacle also includes, as is conventional, a press attachment peg 414 and location pegs 416 and 418.

The top face 428, rear face 430 and a side face 432 and 434 are shown in greater detail. As in the above cited related applications, there are slots for receiving shields in the top face, bottom face and rear face which run parallel to the side faces. Between the shields there are elongated contact receiving slots. At vertical spaced intervals along the shield receiving slot there are also pairs of grooves.

Figure 27:
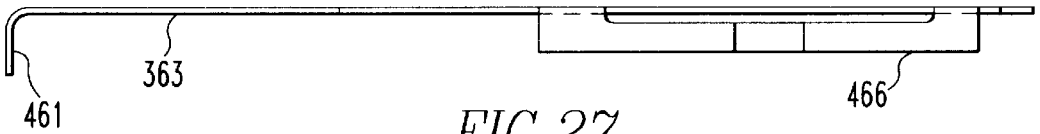
FIG. 27 is a top plan view of the shield shown in FIG. 25.
Figure 25:
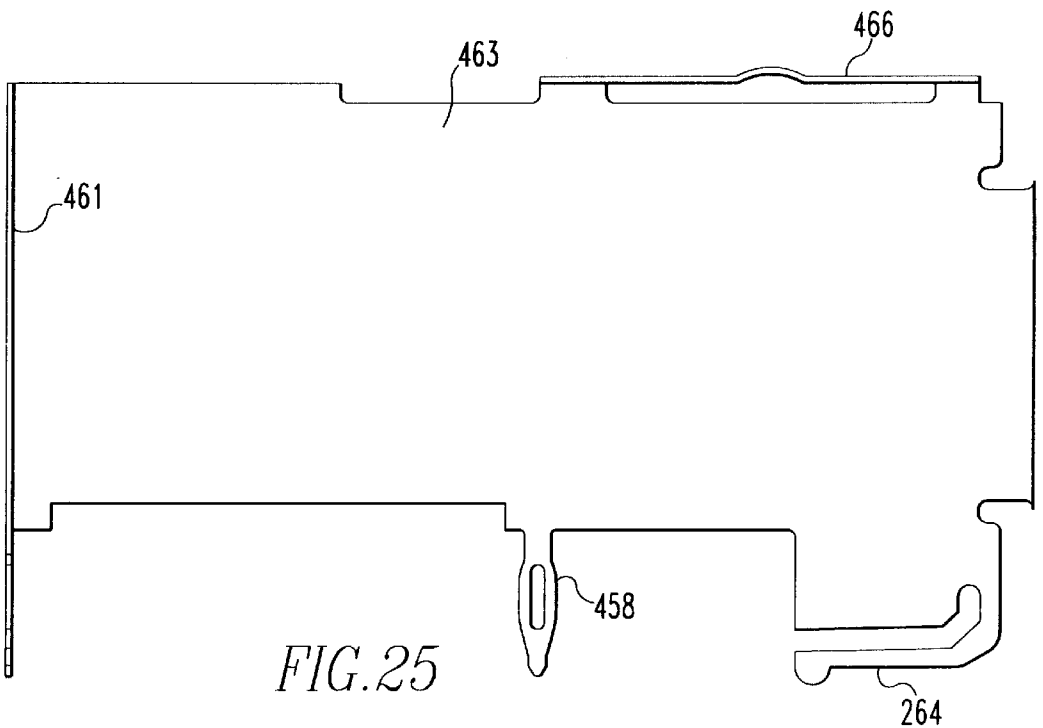
FIG. 25 is a side elevational view of an inner shield in the receptacle shown in FIG. 20.
Figure 26:
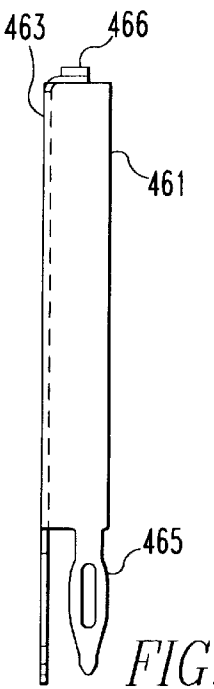
FIG. 26 is a rear end view of the inner shield shown in FIG. 25.
Figure 28:
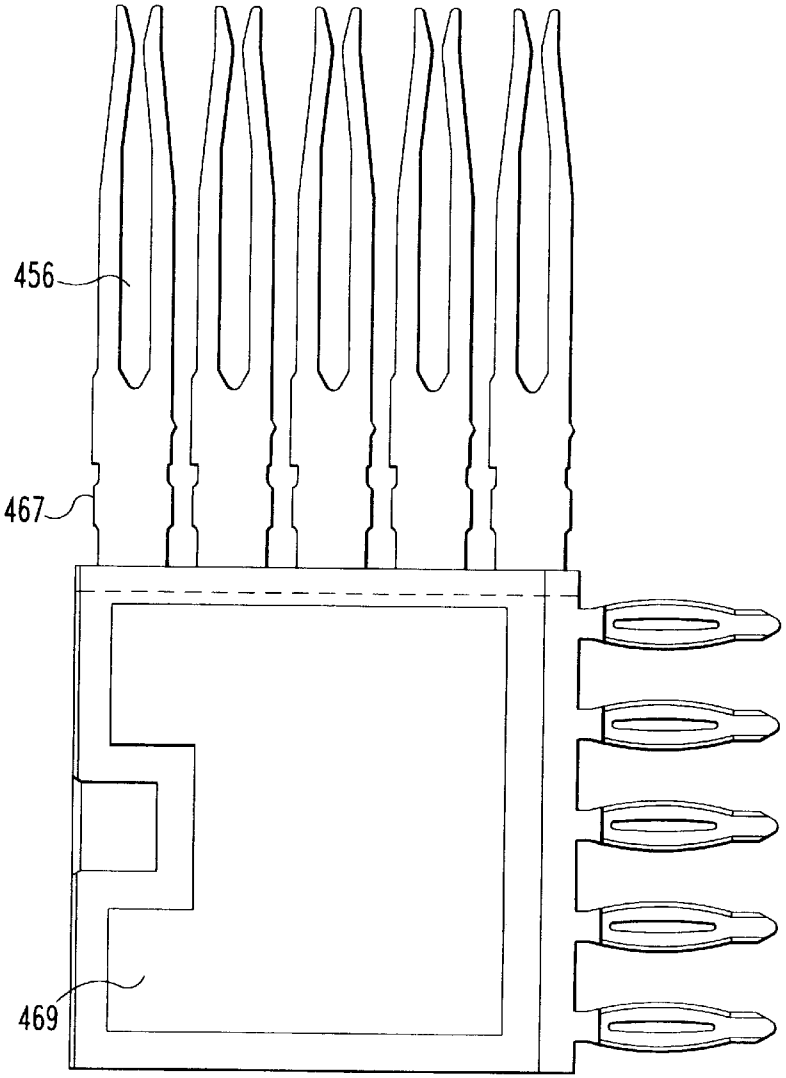
FIG. 28 is a side elevational view of a composite insulative frame and conductive contact which is used in the receptacle shown in FIG. 20.

Referring particularly to FIGS. 25–27, the shields have ground pins as at 458 that pass through the bottom face of the receptacle to be grounded to the PCB. The shield also has a lower resilient ground 458 which extends downwardly through a lower slot in the receptacle then rearwardly to be grounded to a shrouded header. The shield has a rearward section 461 which extends perpendicularly from the main section 463. This rearward section 461 has another lower resilient ground 465. Similarily the shield has an upper resilient ground structure 466 which passes through one of the slots in the upper face of the receptacle to be grounded to a header (not shown). A header which would be suitable for engagement with these resilient ground projections would (for example) either one shown in International Patent Application No. WO96/31922, published Oct. 10, 1996 and assigned to the assignee of this application.

Figure 29:
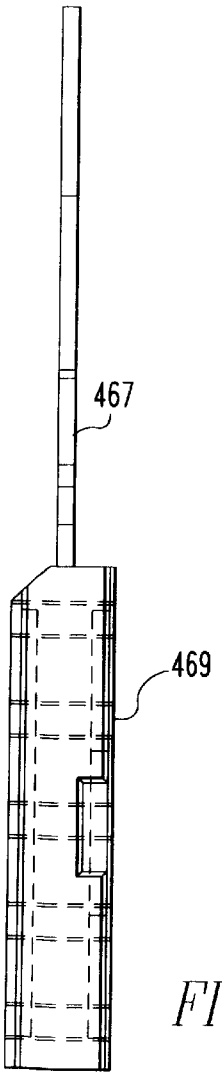
FIG. 29 is an end view of the insulative frame and contacts shown in FIG. 28.
Figure 30:
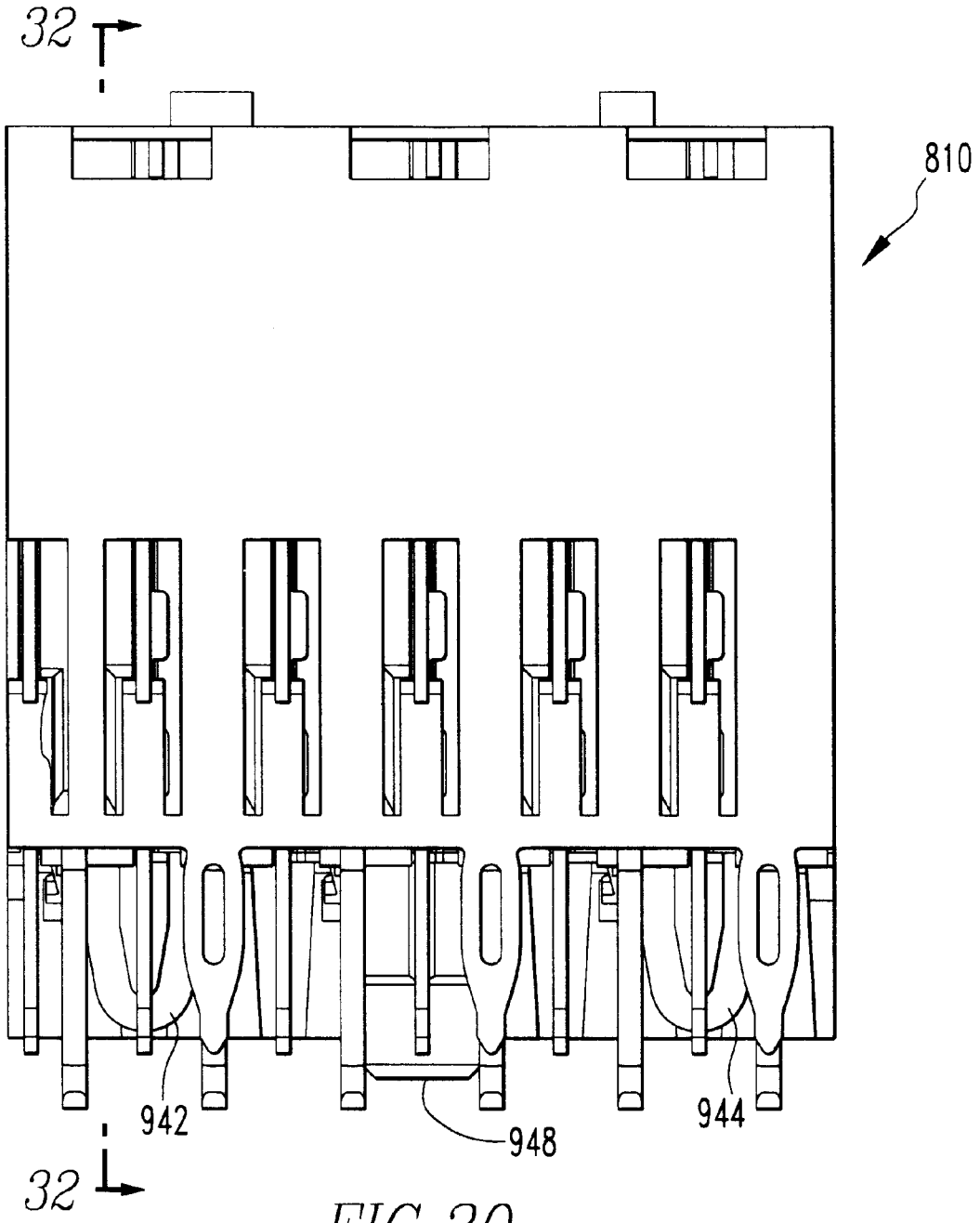
FIG. 30 is a rear plan view of a fourth preferred embodiment of the receptacle of the present invention.
Figure 31:
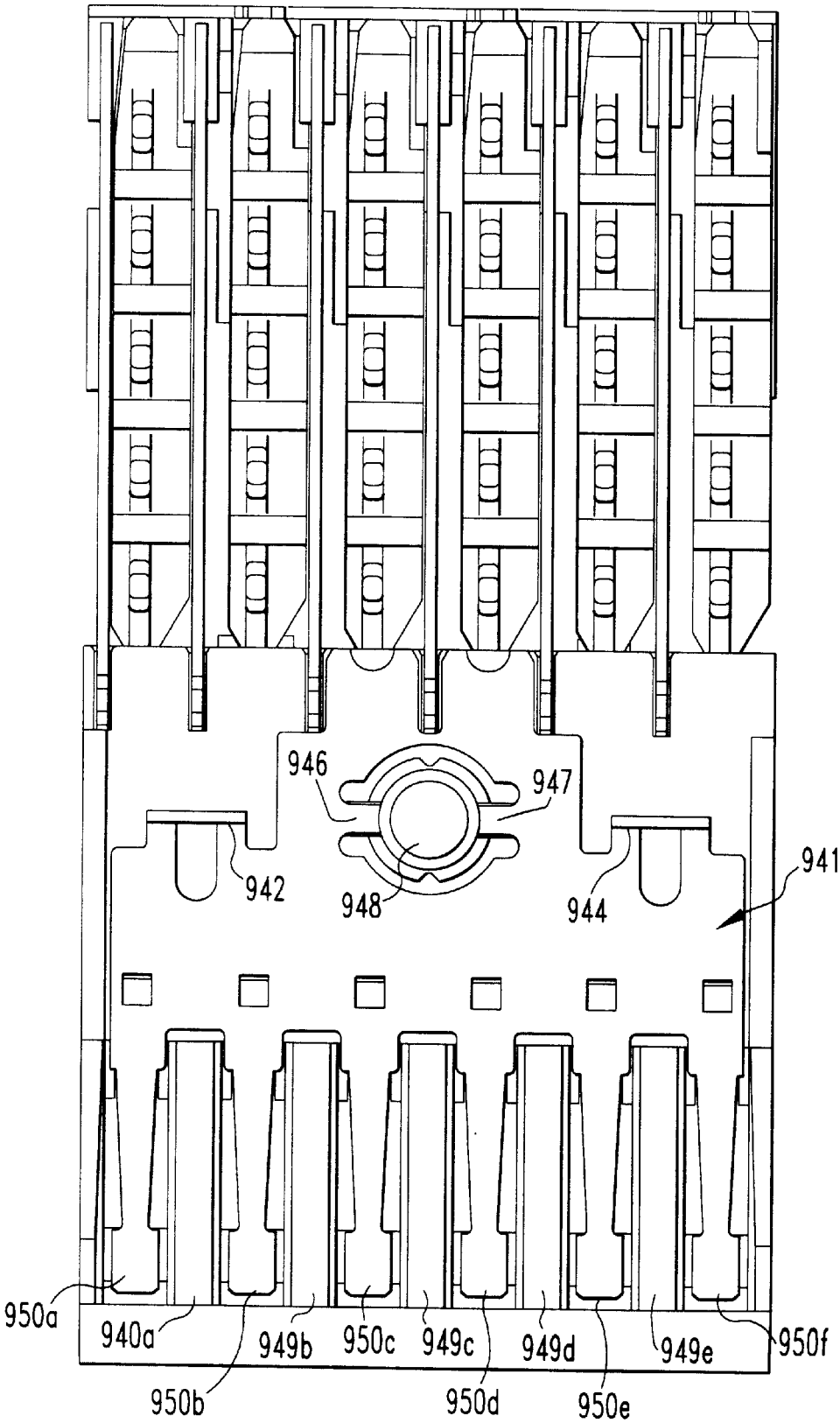
FIG. 31 is a bottom plan view of the receptacle shown in FIG. 30.
Figure 32:
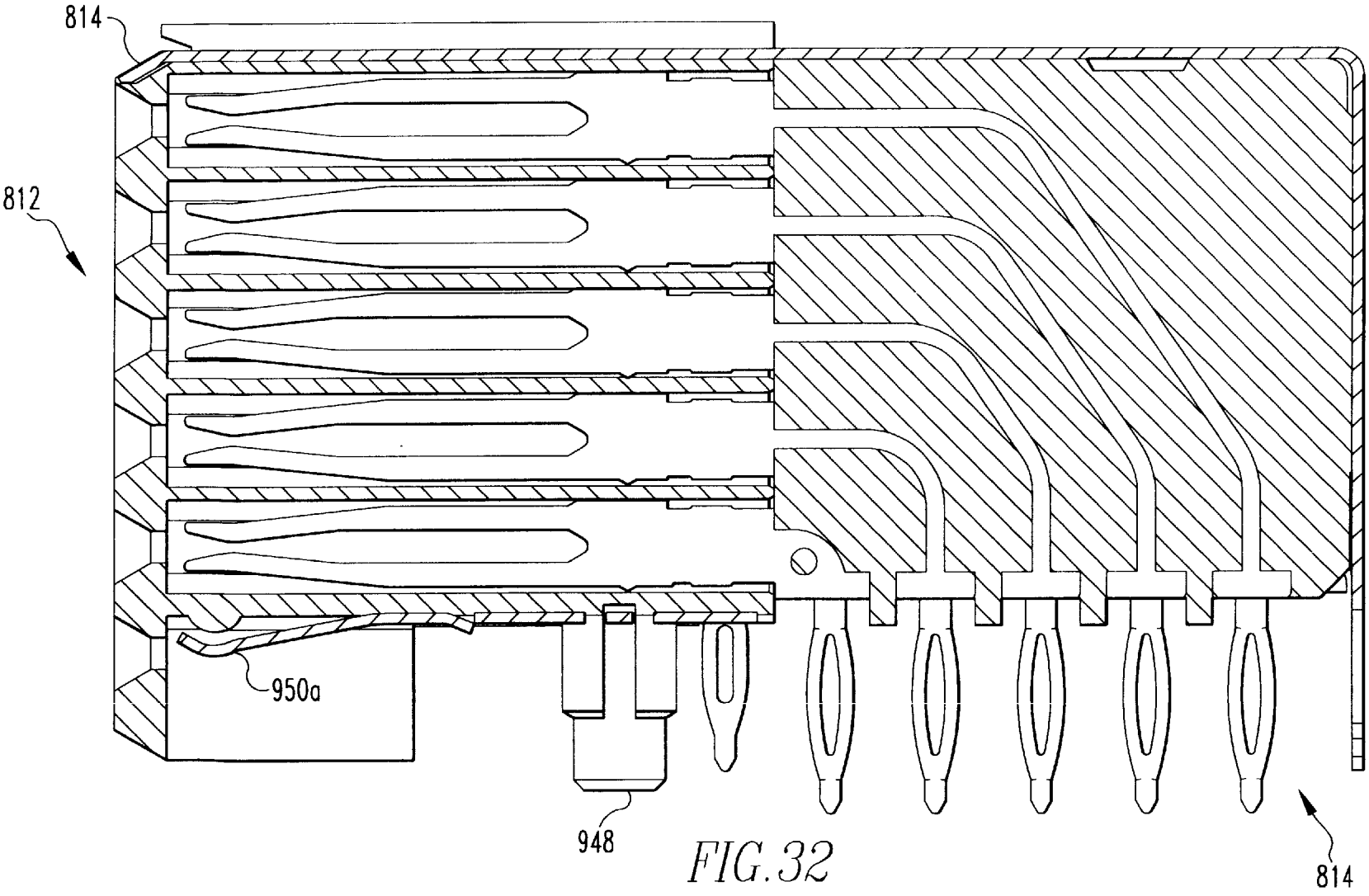
FIG. 32 is a cross sectional view through 32—32 in FIG. 30.
Figure 33:
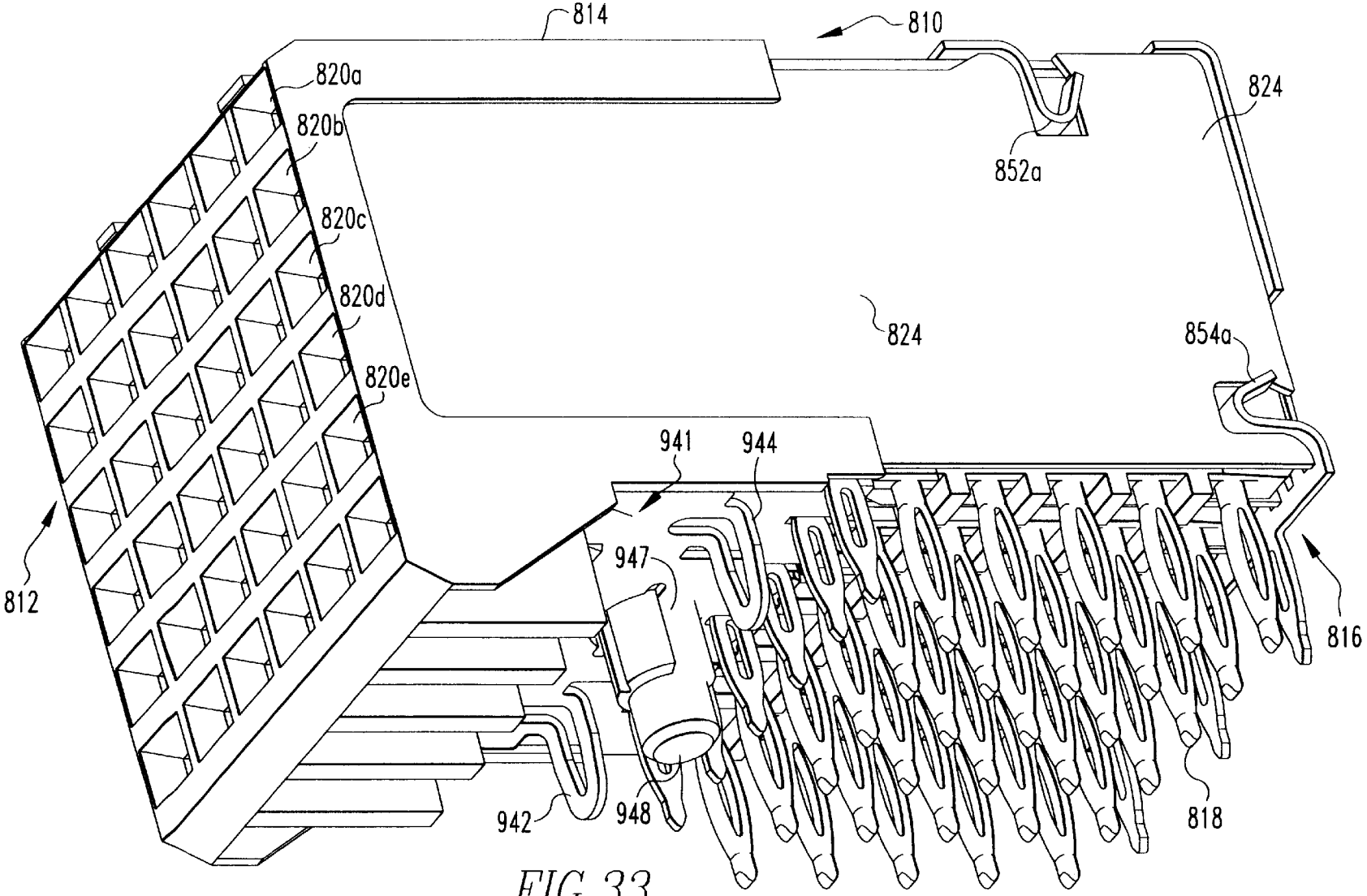
FIG. 33 is a bottom perspective view of the receptacle shown in FIG. 30.
Figure 34:
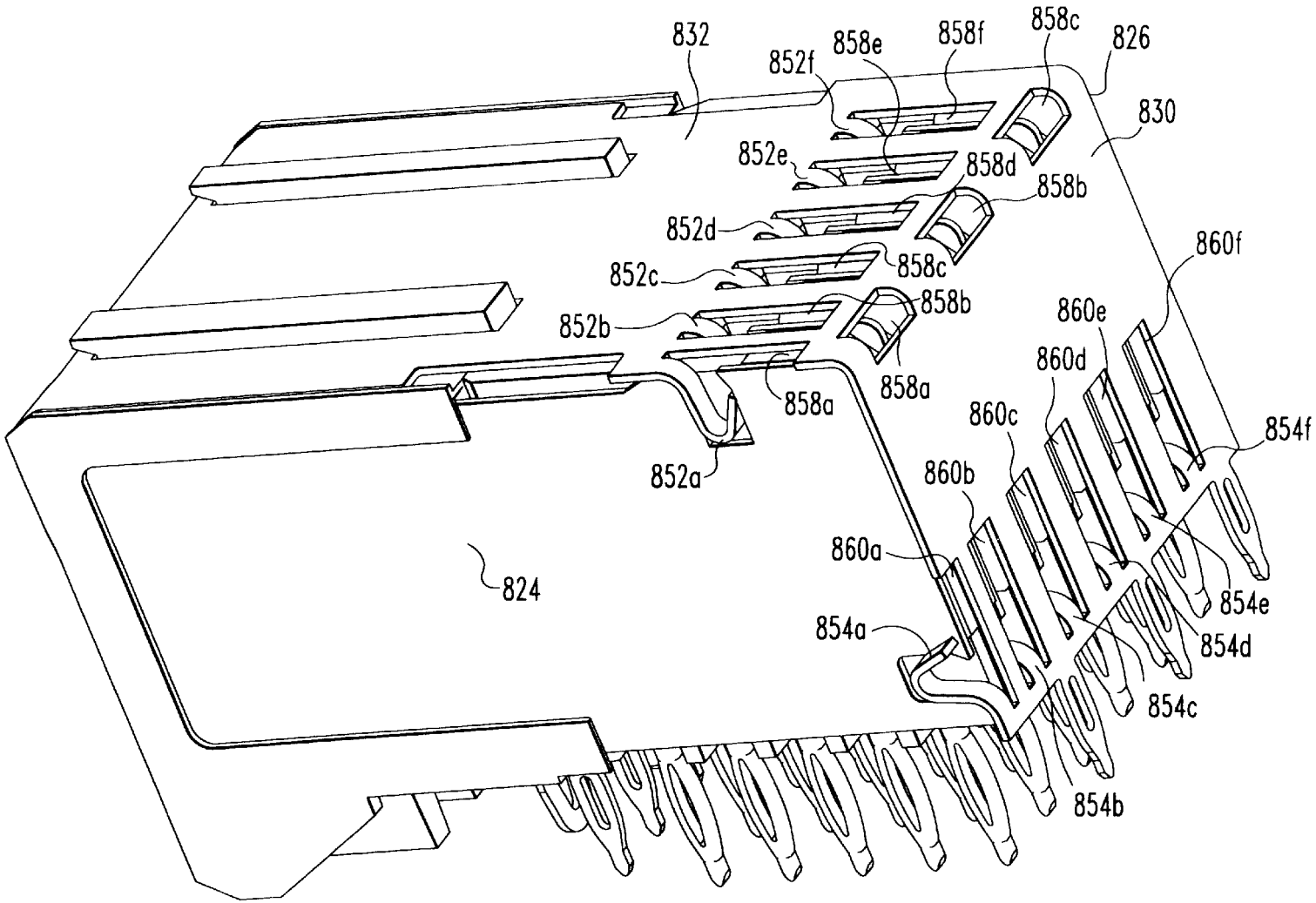
FIG. 34 is a top perspective view of the receptacle shown in FIG. 30.

Referring particularly to FIGS. 29–30, a frame is shown in which the contacts as at contact 467 are held by an insulative member 469. The contacts are integral with the insulative member 469 and at one end they have a terminal as at terminal 471 and at the other end they have a V-shaped structure as at structure 456 to engage pins at the pin receiving aperture. The insulative member 469 also includes mounting recesses as at recess 473 which serve as a ground connection between the contact and the exterior shield.

Figure 35:
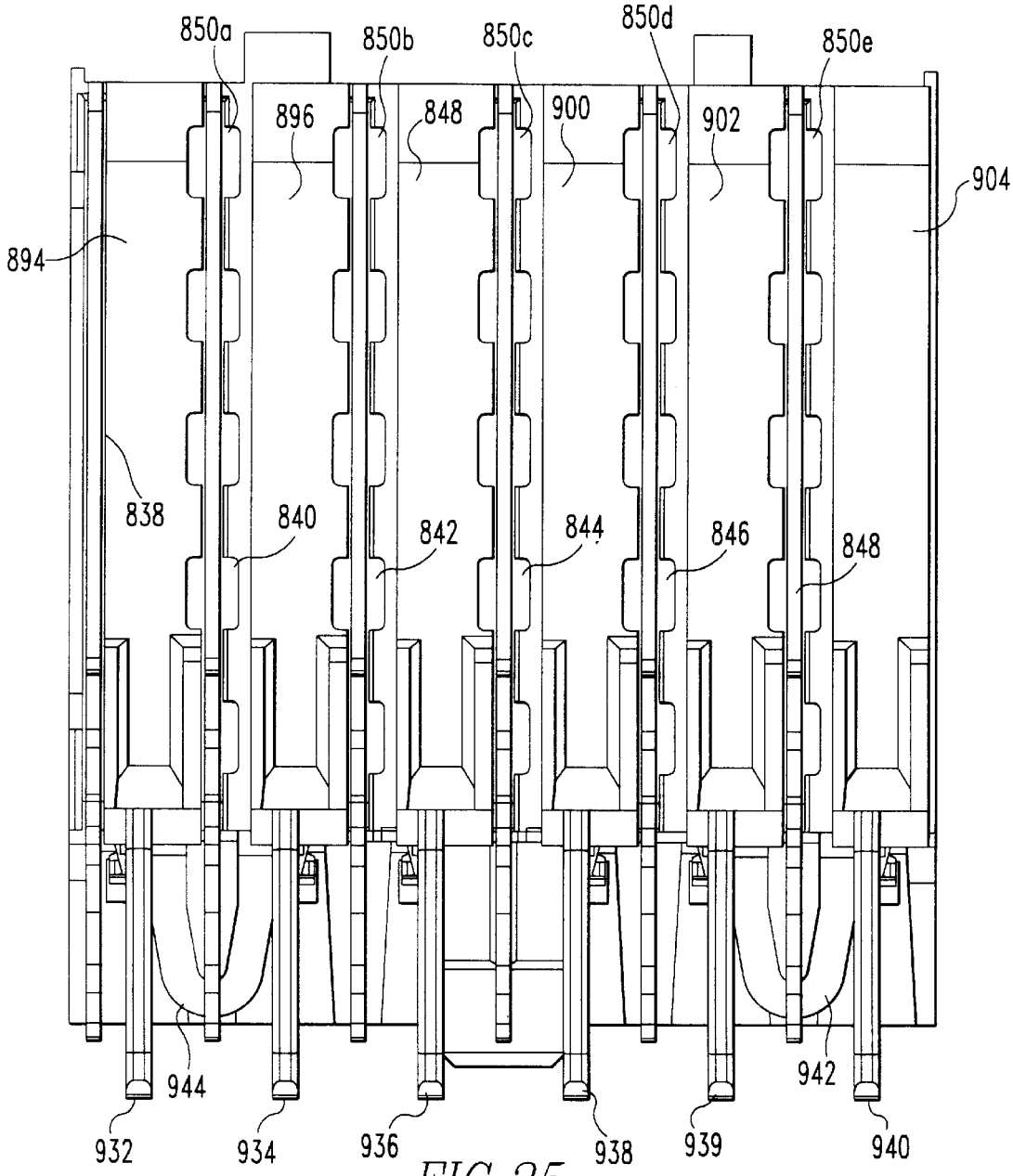
FIG. 35 is a rear plan view of the receptacle shown in FIG. 30 with the top shield removed.

Referring to FIGS. 30–35, a fourth preferred embodiment of the receptacle shown generally at numeral 810. This receptacle has a first face 812 at its front of housing 814 and a second face 816 on its bottom side. A plurality of conductive signal terminals as at terminal 818 extends from the first face 812 to the second face 818. The first face 812 has a plurality of openings in rows 820*a*, 820*b*, 820*c*, 820*d* and 820*e*. In these openings pins form a header, described hereafter, engage signal terminals. The receptacle also includes lateral longitudinal sides 824 and 826 and a top longitudinal side 828. The receptacle also includes an end 830, and an angular external shield 832 is superimposed over the end 830 and the top longitudinal side 828. The longitudinal side 824 is made up of a metallic wall 834. Referring particularly to FIG. 35, it will be seen that there are a plurality of internal shielding walls 838, 840, 842, 844, 846 and 848. Adjacent each of these internal shielding walls there is a longitudinal air space 850*a*, 850*b*, 850*c*, 850*d*, and 850*e*. Each conductive shield has an upper contact latch 852*a*, 852*b*, 852*c*, 852*d*, 852*e* and 852*f*. Similarly these conductive shields also have a lower latch 854*a*, 854*b*, 854*c*, 854*d*, 854*e* and 854*f* (FIG. 35). In the external shield 832 there are also top slots 858*a*–858*f* to accommodate the spring latches 852*a*–852*f*. There are also edge slots 858*a*–858*c* to facilitate bending of the external shield 832 to its angular position. The shield also includes bottom slots 860*a*–860*f* to accommodate the lower spring contact latches.

Referring to FIG. 35, interposed between the conductive shields there are insulative frames 894, 896, 898, 900, 902 and 904. These frames serve to retain the contacts in a way similar to the embodiments described before. For example, in addition to terminal 818 insulative frame 894 holds signal terminals 924, 926, 928 and 930. Each of these terminals extends first upwardly then horizontally. Each of these terminals has respectively at its horizontal end a split pin engagement section 932, 934, 936, 938 and 940. A receptacle also includes a lower conductive plate 941 which has perpendicular extensions 942 and 944. The lower plate 941 has horizontal extensions 946 and 947 which engage mating header pins through respective recesses 946 and 947 extending from the housing. The housing also includes longitudinal partitions 949*a*–949*e*, interposed between these partitions there are contacts 950*a*–950*e*.

Figure 36:
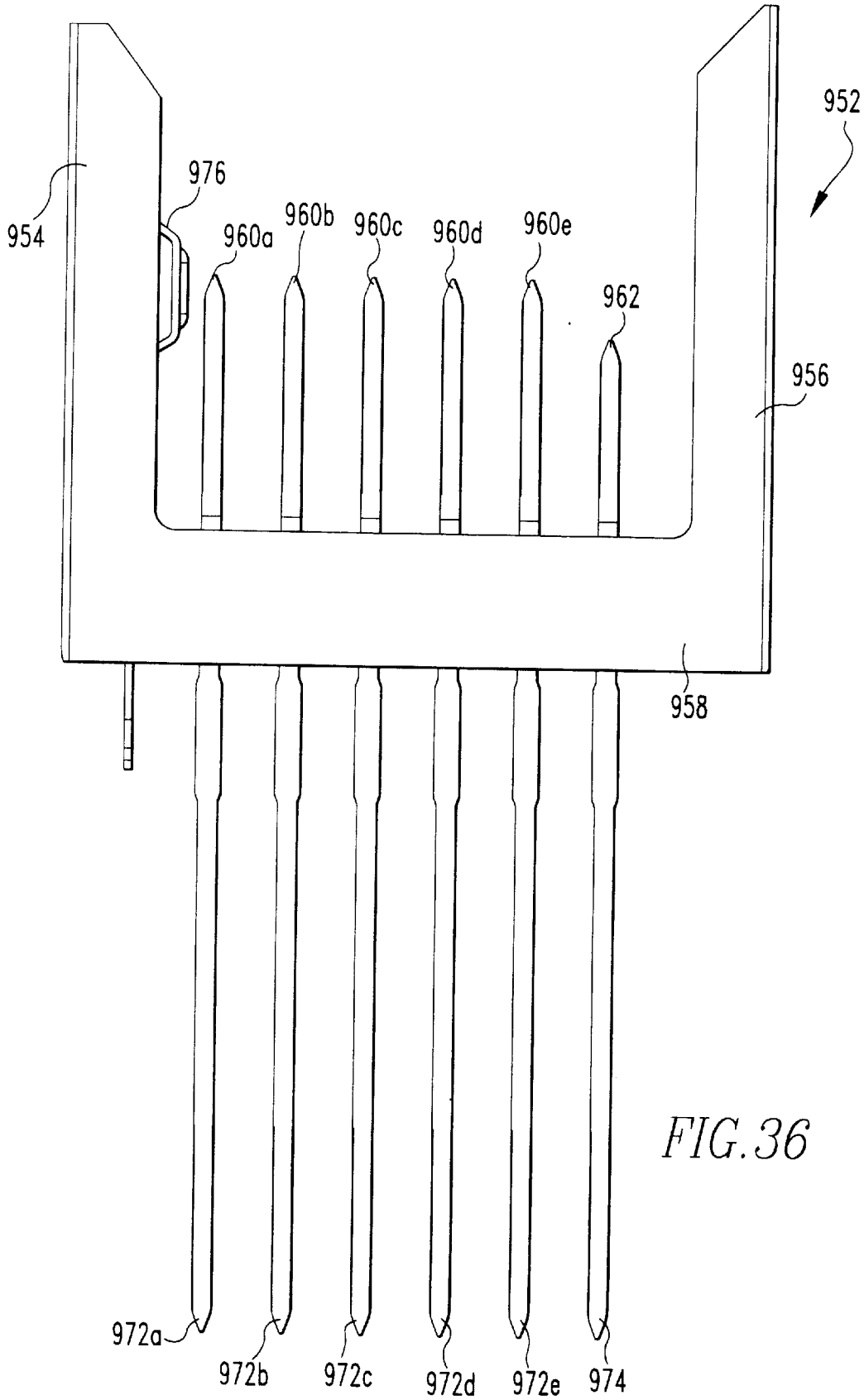
FIG. 36 is a side elevational view of a header adapted to be connected to the receptacle shown in FIG. 30.
Figure 37:
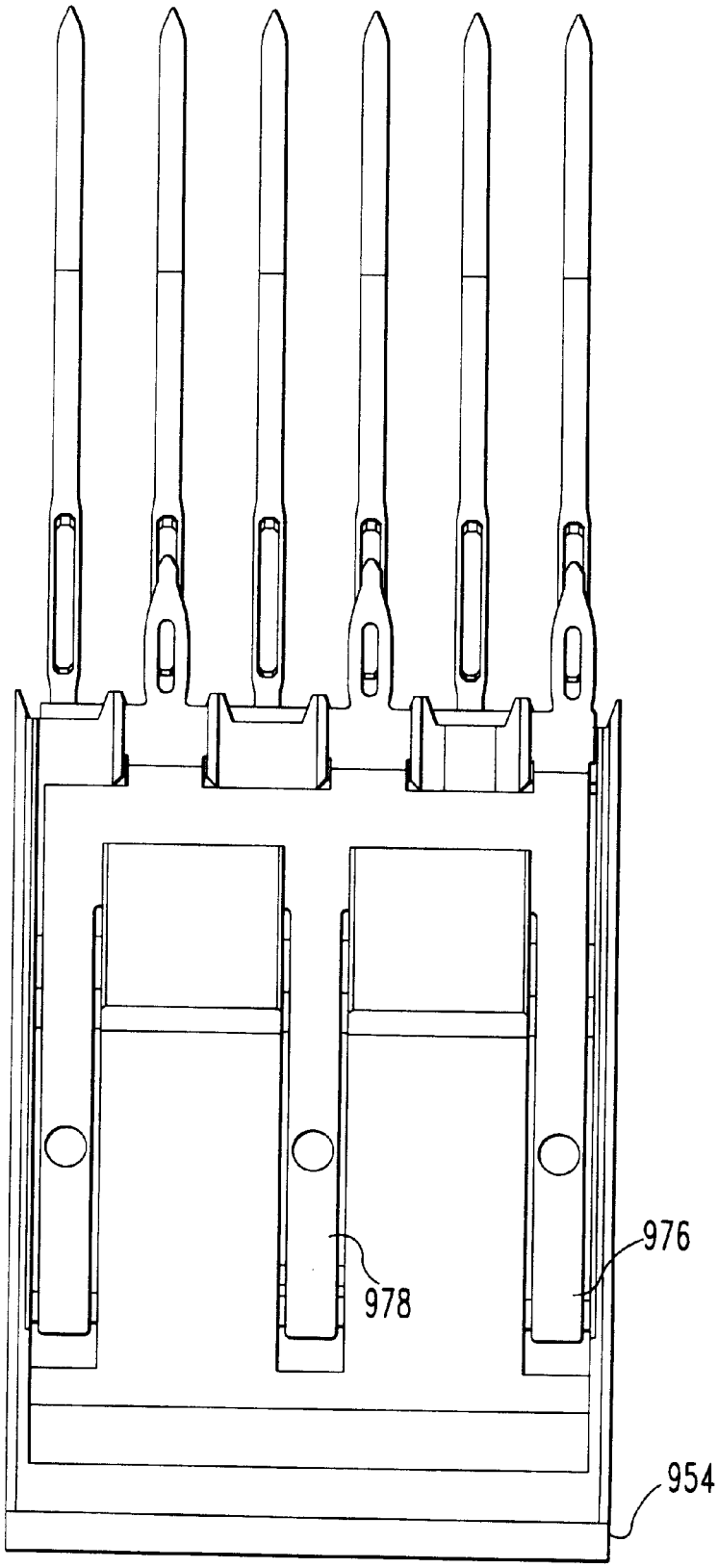
FIG. 37 is a top view of the header shown in FIG. 36.
Figure 38:
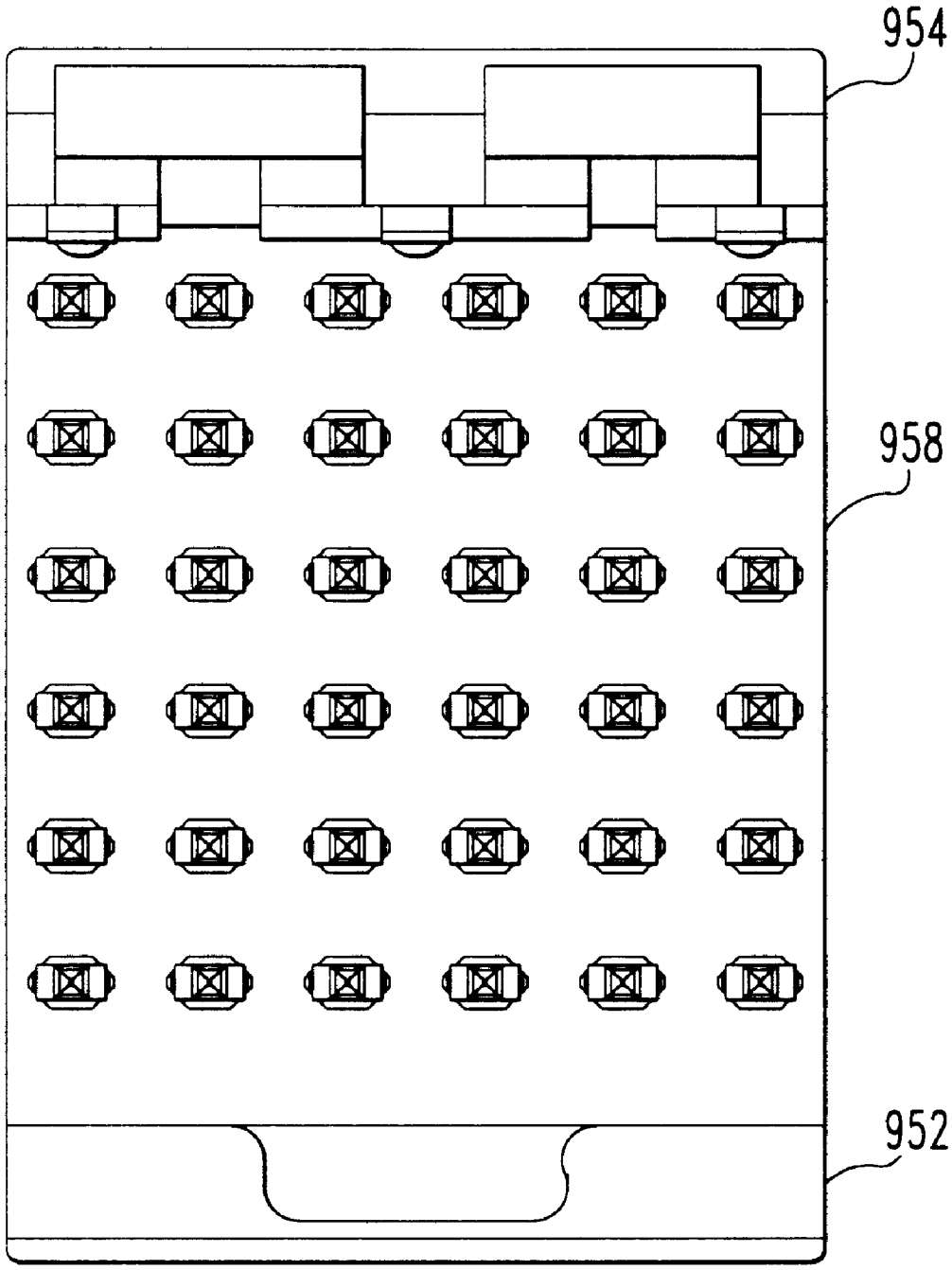
FIG. 38 is a front plan view of the header shown in FIG. 36.

Referring to FIGS. 36–38, a header which is adapted to engage receptacle 810 is shown generally at 952. This header includes end walls 954 and 956 and a medial wall 958. The header also includes rows of signal pins 960*a*–960*e*. There is also a shortened row of ground pins 962. In opposed relation to the pins 960*a*–960*e* there are terminals 972*a*–972*e*, and in opposed relation to pins 962 there are terminals 974. In wall 954 there are also ground contacts 976 and 978.

Figure 41:
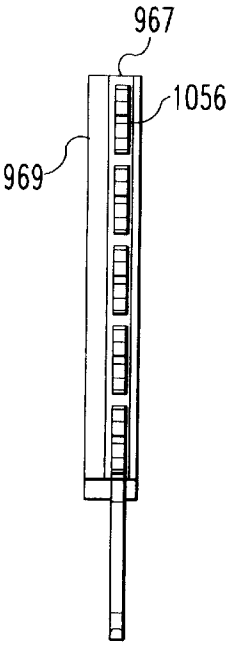
FIG. 41 is a top view of the composite insulative frame and conductive contacts shown in FIG. 40.
Figure 39:
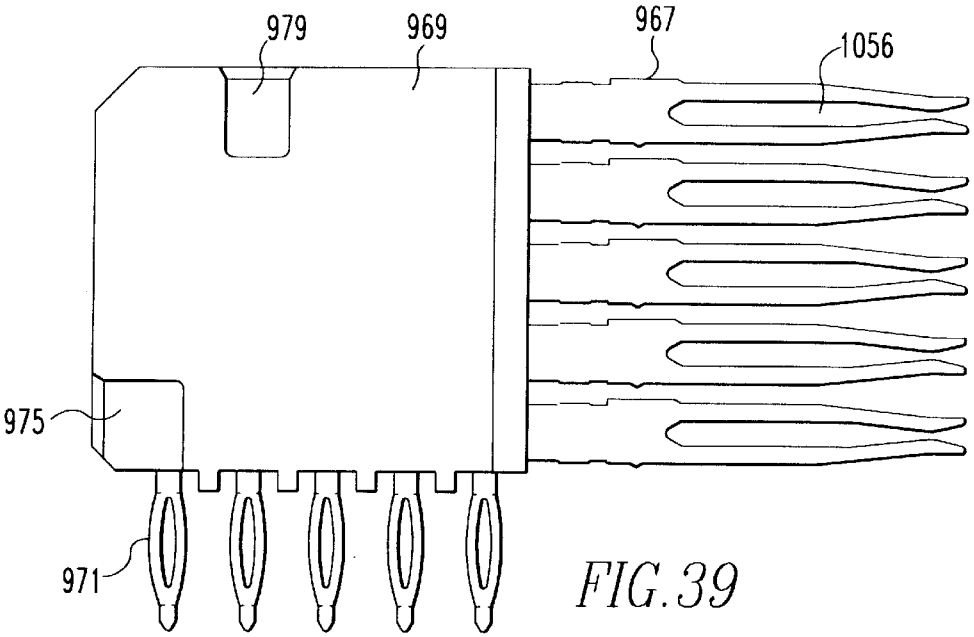
FIG. 39 is a side elevational view of a composite insulative frame and conductive contacts which may be used in the receptacle shown in FIG. 30.
Figure 40:
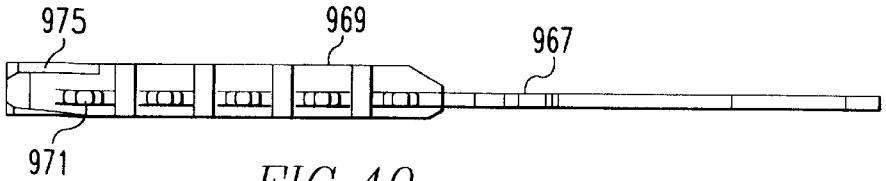
FIG. 40 is an end view of the composite insulative frame and conductive contacts which is shown in FIG. 39.

Referring to FIGS. 39–41, a preferred insulative frame includes for use in the receptacle shown in FIG. 30 includes contacts as at contact 967 held by an insulative member 969. The contacts are integral with the insulative member 969 and at one end they have a terminal and at the other end they have a V-shaped structure as at structure 1056 to engage pins at the pin receiving aperture. The insulative member 969 also includes mounting recesses as at recesses 975 and 977 which serve as ground connections between the contacts and the interior shell.

It will be appreciated that there has been described a simple and inexpensive receptacle which provides for effective shielding and grounding between mother and daughter boards, as well as signal carrying conductors.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A receptacle for an electrical connector comprising a housing having a first face and a second face and a plurality of electrical terminals each extending from said first face to said second face; a plurality of longitudinal sides interposed between said first face and said second face; and conductive shielding superimposed over at least some of said longitudinal sides, said conductive shielding comprising a plurality of latches extending into said housing and proximal to at least some of said plurality of electrical terminals.

2. The receptacle of claim 1 further comprising internal shielding interposed between at least some of said plurality of electrical terminals.

3. The receptacle of claim 1 wherein said plurality of electrical terminals are retained in a plurality of insulative frames.

4. The receptacle of claim 2 wherein said plurality of electrical terminals are flattened to be interposed between adjacent internal shielding.

5. The receptacle of claim 3 wherein said plurality of latches are provided to fix each of said insulative frames to said housing.

6. The receptacle of claim 2 wherein said internal shielding comprises a plurality of parallel longitudinal walls to form a plurality of longitudinal spaces between said longitudinal walls and one of said plurality of electrical terminals is positioned in each of said longitudinal spaces.

7. The receptacle of claim 1 wherein said plurality of latches are formed by bending said conductive shielding at discrete locations through a corresponding plurality of slots.

8. The receptacle of claim 6 wherein at least some of said plurality of longitudinal walls has a ground structure for grounding to a header.

9. The receptacle of claim 8 wherein said ground structure is resilient.

10. The receptacle of claim 1 wherein grounding is provided.

11. An electrical connector comprising in combination a receptacle comprising a housing having a first face and a second face and a plurality of electrical terminals each extending from said first face to said second face, a plurality of longitudinal sides interposed between said first face and said second face, and conductive shielding superimposed over at least some of said longitudinal sides and comprising a plurality of latches extending into said housing and proximal to at least some of said plurality of electrical terminals; and a header having a conductive housing comprising generally parallel end walls with opposed inner faces and a medial wall having a first face and a second face wherein said first face of the medial wall is adjacent to the second face of said receptacle housing and a plurality of passages extend between the first and second faces of the medial walls and a plurality of conductive signal pins pass through at least some of said passages and separate grounding is attached to the conductive housing of the header.

12. The electrical connector of claim 11 further comprising ground contacts on a bottom side of the receptacle housing.

13. A receptacle for an electrical connector comprising:

a housing comprising a first face, a second face, an end opposite said first face, two lateral longitudinal sides and a top longitudinal side each interposed between said first face and said end;

a plurality of electrical terminals each extending from said first face to said second face;

internal conductive shielding interposed between at least some of said plurality of electrical terminals;

external conductive shielding comprising a first portion superimposed over said top longitudinal side and a second portion superimposed over said end;

wherein at least one of said first portion and said second portion comprises a plurality of latches extending into said housing and proximal to at least some of said plurality of electrical terminals.

14. The receptacle of claim 13 wherein both of said first portion and said second portion comprise a plurality of latches.

15. The receptacle of claim 13 wherein said external conductive shielding further comprises latches disposed within slots in said lateral longitudinal sides.

16. The receptacle of claim 13 wherein said external conductive shielding further comprises edge slots interposed between said first and second portions to facilitate bending said external conductive shielding.

* * * * *